US009834032B2

(12) United States Patent
Oomoto

(10) Patent No.: US 9,834,032 B2
(45) Date of Patent: Dec. 5, 2017

(54) MECHANICAL PENCIL

(71) Applicant: MITSUBISHI PENCIL COMPANY, LIMITED, Tokyo (JP)

(72) Inventor: Kei Oomoto, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 212 days.

(21) Appl. No.: 14/762,018

(22) PCT Filed: Jan. 27, 2014

(86) PCT No.: PCT/JP2014/051658
§ 371 (c)(1),
(2) Date: Jul. 20, 2015

(87) PCT Pub. No.: WO2014/119508
PCT Pub. Date: Aug. 7, 2014

(65) Prior Publication Data

US 2015/0336419 A1 Nov. 26, 2015

(30) Foreign Application Priority Data

Jan. 29, 2013 (JP) ..... 2013-014155
Jan. 23, 2014 (JP) ..... 2014-010208

(51) Int. Cl.
*B43K 21/00* (2006.01)
*B43K 21/16* (2006.01)
(Continued)

(52) U.S. Cl.
CPC ..... *B43K 21/006* (2013.01); *B43K 21/00* (2013.01); *B43K 21/16* (2013.01); *B43K 21/22* (2013.01); *B43K 23/008* (2013.01); *B43K 29/02* (2013.01)

(58) Field of Classification Search
CPC combination set(s) only.
See application file for complete search history.

(56) References Cited

U.S. PATENT DOCUMENTS 3,850,531 A 11/1974 Ackermann
7,802,936 B1 * 9/2010 Izawa ..... B43K 21/003 401/194
(Continued)

FOREIGN PATENT DOCUMENTS

EA 2 218 586 A1 8/2010
EP 2 202 090 A1 6/2010
(Continued)

OTHER PUBLICATIONS

International Search Report dated Apr. 22, 2014, issued in counterpart application No. PCT/JP2014/051658 (1 page).
(Continued)

*Primary Examiner* — David Walczak
(74) *Attorney, Agent, or Firm* — Westerman, Hattori, Daniels & Adrian, LLP

(57) ABSTRACT

A mechanical pencil which is configured so that a rotatable cam is rotationally driven with an axis of the rotatable cam relative to a holder member stabled, and smooth operation of a rotational drive mechanism is ensured. The mechanical pencil includes a rotational drive mechanism for driving rotationally a rotatable cam according to writing pressure applied to a writing lead, and transfer rotational motion of the rotatable cam to the writing lead. The rotational drive mechanism includes a holder member supporting the rotatable cam so as to be rotatable, a first fixed cam formed with a funnel-shaped inclined surface Fu and a second fixed cam formed at an obtuse angle α relative to an axial direction. Cam faces of an upper cam and a lower cam alternately meshing with the first and second fixed cams are formed along a conical inclined surface Cs.

15 Claims, 25 Drawing Sheets

(51) Int. Cl.

| | |
|---|---|
| ***B43K 21/22*** | (2006.01) |
| ***B43K 23/008*** | (2006.01) |
| ***B43K 29/02*** | (2006.01) |

(56) References Cited

U.S. PATENT DOCUMENTS

| | | | | |
|---|---|---|---|---|
| 8,337,107 | B2 * | 12/2012 | Ohsawa ..... | B43K 21/003 401/92 |
| 2014/0016982 | A1 | 1/2014 | Izawa et al. | |

FOREIGN PATENT DOCUMENTS

| | | | |
|---|---|---|---|
| JP | 2009-160736 | A | 7/2009 |
| JP | 2010-23229 | A | 2/2010 |
| JP | 2010-94954 | A | 4/2010 |
| JP | 2010-120204 | A | 6/2010 |
| JP | 2012-218267 | A | 11/2012 |
| JP | 2013-936 | A | 1/2013 |

OTHER PUBLICATIONS

Extended (Supplementary) European Search Report dated Dec. 9, 2016, issued in the counterpart European Patent Application No. 14746422.6. (8 pages).

* cited by examiner (A)

(B)

(C)

(A)

(B)

(C)

MECHANICAL PENCIL

TECHNICAL FIELD

The present invention relates to a mechanical pencil which can rotate a writing lead (refill lead) using writing pressure, and in particular to improvement of a rotational drive mechanism for rotationally driving the writing lead.

BACKGROUND ART

As is well known, a mechanical pencil has a problem that a drawn line width may change because a writing lead locally abrades as the writing proceeds.

The present applicant has previously proposed a mechanical pencil with a rotational drive mechanism in which the writing lead is gradually rotated in one direction using writing pressure applied to the writing lead. This is disclosed in Patent Documents 1, 2, and the like.

According to this mechanical pencil, when the mechanical pencil is used to perform writing with a body cylinder inclined to the writing side (page) at around 40 to 80 degrees, for example, each time a stroke is drawn, the writing lead is slightly rotationally driven in one direction, so that a tip portion of the writing lead is always kept sharp in the shape of a cone. Therefore, the mechanical pencil allows writing with almost the same line width.

There are other proposals for mechanical pencils with a rotational drive mechanism for writing lead. For example, a mechanical pencil disclosed in Patent Document 3 has a rotatable cam with upper and lower cam faces continued in a circle that is integrated in a slider protruded to the front of a body cylinder. The mechanical pencil is configured such that first and second fixed cams are alternately meshed with the upper and lower cam faces of the rotatable cam within a base member positioned on the outside of the slider.

Further, Patent Document 4 discloses a configuration of a mechanical pencil in which a first cam face is formed in a circle in a base member and a second cam face is formed in a circle in a stopper member attached to the rear end of the base member. A cam protrusion is protruded in a direction orthogonal to an axial direction from a side surface of a sleeve rotating together with a chuck holding a writing lead. In the mechanical pencil, a lead rotational mechanism is configured such that a cam protrusion is provided on a side surface of a sleeve rotating with a chuck grasping a writing lead, and the cam protrusion is orthogonal to the axial member and travels between the first cam face and the second cam face.

PRIOR ART DOCUMENTS

Patent Documents

Patent Document 1: JP 2009-160736 A
Patent Document 2: JP 2010-23229 A
Patent Document 3: JP 2010-94954 A
Patent Document 4: JP 2010-120204 A Each of the rotational drive mechanisms for writing lead disclosed in Patent Documents 1 to 4 includes a rotatable cam that moves axially under writing pressure, and first and second fixed cams that face each other with upper and lower cam faces of the rotatable cam therebetween.

The rotatable cam has the upper and lower axial cam faces, and the first and second fixed cams have cam faces continued in a circle.

In addition, in the rotational drive mechanism for writing lead described above, the rotatable cam has the upper and lower cam faces formed in parallel to planes orthogonal to the axial direction. The first and second fixed cams meshing with the rotatable cam also have annularly continued cam faces in parallel to planes orthogonal to the axial direction.

The rotatable cam in the rotational drive mechanism needs to be provided with a slight clearance from a member supporting the rotatable cam so that the rotatable cam can be rotatably supported in the body cylinder. However, the presence of the clearance effects a shift in the axis of the rotatable cam, which may deteriorate the accuracy of mesh of the cam faces in the rotational drive mechanism.

This causes an essential problem that it is difficult to ensure smooth rotational drive operation of the rotational drive mechanism.

Meanwhile, each of the rotational drive mechanisms for writing lead disclosed in Patent Documents 1 and 2 filed by the present applicant, is configured such that the three components, that is, the rotatable cam and fixed cam formation members for the first and second fixed cams, are assembled together, and a spring as a separate component for axially biasing the rotatable cam is incorporated. According to this configuration, it is necessary to take measures such as forming a concavo-convex positioning mechanism, for example, between the first and second fixed cams to keep the circumferential pitches of the cam faces in the first and second fixed cams in a specific relationship.

However, even if such a measure is taken as described above, it is difficult to ensure high accuracy of meshing of the cam faces in the rotational drive mechanism by the action of synergy among mold variations between the cam face of a first fixed cam and the positioning mechanism, mold variations between the cam face of a second fixed cam and the positioning mechanism, and the clearance in the concavo-convex positioning mechanism. In addition, a large number of man-hours are required to assemble the rotational drive mechanism by combining these many components.

To solve the foregoing problems, the present applicant has filed previous applications for mechanical pencils with rotational drive mechanism as JP 2012-40399 A and JP 2012-40400 A.

According to these mechanical pencils, it is possible to achieve simplified cam structures of the first and second fixed cams and a reduced parts count, and ensure ease of assembly of the rotational drive mechanism.

The rotational drive mechanism in the mechanical pencil for which the present applicant has previously filed an application is configured such that the first and second fixed cams are integrally formed with a holder member for holding the rotatable cam, and a cushion member made of a soft elastic material for pushing out the rotatable cam in the axial direction is integrated with the holder member by two-color molding, for example.

To form the foregoing holder member by injection molding, the metal mold used is designed to be axially divided into right and left portions at the time of mold release.

In this case, slight burrs may be produced at the seams between the right and left metal mold portions. This may result in a problem that the burrs protrude toward the rotatable cam and the tips of the burrs hit the sawtooth cam faces of the rotatable cam to interfere with normal rotational motion of the rotatable cam.

In the case where the metal mold is axially divided into right and left portions as described above, the first and second fixed cams formed as sawtooth cam faces need to be formed corresponding to the seams in the metal mold to allow mold release.

SUMMARY OF THE INVENTION

Problems to be Solved by the Invention

The present invention has been revised to solve the foregoing problems with a mechanical pencil including a rotational drive mechanism for writing lead, and aims to provide a mechanical pencil configured such that cam faces of first and second fixed cams and cam faces of a rotatable cam in the rotational drive mechanism are shaped to allow the rotatable cam to be rotationally driven with an axis stabled, thereby to ensure more smooth rotational drive operation of the rotational drive mechanism.

The present invention is also intended to provide a mechanical pencil configured such that the first and second fixed cams in the holder member constituting the rotational drive mechanism are shaped to allow a metal mold for use in injection molding to be removed in the axial direction.

Means for Solving the Problems

To solve the above-described problem, a mechanical pencil according to the invention configured to include a rotational drive mechanism for driving rotationally a rotatable cam according to writing pressure applied to a writing lead, and transfer rotational motion of the rotatable cam to the writing lead, wherein the rotational drive mechanism includes a rotatable cam with upper and lower cam faces orthogonal to an axial direction, and a first fixed cam and a second fixed cam facing each other with the upper and lower cam faces of the rotatable cam therebetween, at least one of the first fixed cam and the second fixed cam has a cam face formed on a funnel-shaped inclined surface, and a cam face of the rotatable cam meshing with the cam face on the funnel-shaped inclined surface is formed on a conical inclined surface.

In this case, the rotational drive mechanism may be preferably configured such that the rotatable cam is supported so as to be rotatable and axially movable, the rotatable cam is axially moved backward under writing pressure applied to the writing lead and is axially moved forward by release of the writing pressure, the upper cam face and the lower cam face of the rotatable cam are formed by a plurality of circular cam faces, and the first fixed cam and the second fixed cam are formed by a plurality of circular cam faces.

It is also preferred that the cam faces of the first fixed cam and the second fixed cam are formed on funnel-shaped inclined surfaces, and the upper cam face and the lower cam face of the rotatable cam are formed on conical inclined surfaces.

In a preferred embodiment, the first fixed cam is formed in a first cylindrical cam formation member, the second fixed cam is formed in a second cylindrical cam formation member, and the first cam formation member and the second cam formation member are axially joined together.

In another preferred embodiment, the first fixed cam and the second fixed cam are formed within a base member arranged at a front end portion of a body cylinder constituting an outer part of the mechanical pencil, and the rotatable cam including the upper and lower cam faces is molded integrally with a slider positioned in the base member.

In still another preferred embodiment, the first fixed cam is formed at a stopper attached to the rear end portion of the base member, the second fixed cam is formed in the base member, and the rotatable cam including the upper and lower cam faces is accommodated in the base member.

To solve the above-mentioned problems, another mechanical pencil according to the present invention is configured to include a rotational drive mechanism for driving rotationally a rotatable cam according to writing pressure applied to a writing lead, and transfer rotational motion of the rotatable cam to the writing lead, wherein the rotational drive mechanism includes a holder member that supports the rotatable cam so as to be rotatable and axially movable, the rotatable cam is axially moved backward under the writing pressure applied to the writing lead and is axially moved forward by release of the writing pressure, the rotatable cam has upper and lower surfaces orthogonal to the axial direction formed with a plurality of circular cam faces, a first fixed cam and a second fixed cam are formed at a base portion and a tip portion of an axially long elastic member molded integrally with the holder member, so as to face each other with upper and lower cam faces of the rotatable cam therebetween, the second fixed cam at the tip portion of the elastic member is formed on an inclined surface bent at an obtuse angle from the longitudinal tip portion of the elastic member toward an axis of the holder member, and the cam face of the lower cam in the rotatable cam meshing with the cam face of the second fixed cam is formed on a conical inclined surface.

In this case, it is desired that a cylindrical portion is formed at the base portion of the elastic member in the holder member to support the rotatable cam so as to be rotatable and axially movable, the first fixed cam with a plurality of circular cam faces is formed at the cylindrical portion, the cam faces of the first fixed cam are formed on a funnel-shaped inclined surface, and the cam face of the upper cam in the rotatable cam meshing with the cam faces of the first fixed cam is formed on a conical inclined surface.

The second fixed cam is preferably configured such that the second fixed cam is configured such that two cam faces intersect with each other at one ridge line on an inclined surface bent at an obtuse angle from the longitudinal tip portion of the elastic member toward the axis to shape a sawtooth cam, and a line extended from the ridge line is directed toward the axis.

It is also desired that the second fixed cam is formed to meet the relationship $\alpha 1<\alpha 2$ where the angle formed by the inclined surface bent at an obtuse angle from the longitudinal tip portion of the elastic member toward the axis and the line directed toward the longitudinal tip portion of the elastic member is designated as $\alpha 1$, and the angle formed by the ridge line of the cam in the second fixed cam and the line directed toward the longitudinal tip portion of the elastic member is designated as $\alpha 2$.

In another preferred embodiment, an abutting portion is formed on the outer surface of the elastic member to be in abutment with a part of an inner periphery of the body cylinder or a part of the inner periphery of a member arranged between the body cylinder and the holder member, and the abutting portion is configured to reduce the degree of expansion of the elastic member from the axis toward the outside.

In this case, it is also preferred that a tapered face is formed at the tip portion of the elastic member, and a part of the body cylinder or a part of the member arranged between the body cylinder and the holder member comes into axial contact with the tapered face to provide a biasing force to cause the elastic member to expand from the axis toward the outside.

To solve the foregoing problems, the mechanical pencil in another embodiment of a mechanical pencil according to the present invention is configured to include a rotational drive mechanism for driving rotationally a rotatable cam according to writing pressure applied to a writing lead, and transfer rotational motion of the rotatable cam to the writing lead, wherein the rotational drive mechanism includes a holder member that supports the rotatable cam so as to be rotatable and axially movable, the rotatable cam is axially moved backward under the writing pressure applied to the writing lead and is axially moved forward by release of the writing pressure, the rotatable cam has upper and lower surfaces orthogonal to the axial direction formed with a plurality of circular cam faces, a first fixed cam and a second fixed cam are formed at a base portion and a tip portion of an axially long elastic member molded integrally with the holder member, so as to face each other with upper and lower cam faces of the rotatable cam therebetween, a cylindrical portion is formed at the base portion of the elastic member in the holder member to support the rotatable cam so as to be rotatable and axially movable, the first fixed cam with a plurality of circular cam faces is formed at the cylindrical portion, the cam faces of the first fixed cam are formed on a funnel-shaped inclined surface, and the cam face of the upper cam in the rotatable cam meshing with the cam faces of the first fixed cam is formed on a conical inclined surface.

In each of the foregoing embodiments, the holder member desirably includes a cushion member to push axially the rotatable cam supported by the holder member, a slip member is arranged between the cushion member and the rotatable cam to come into contact with the axial rear end surface of the rotatable cam and slip between the cushion member and the rotatable cam, and the slip member is attached to the cushion member.

In this case, it is preferred that the cushion member is attached to the holder member by two-color molding, and the slip member is attached to the cushion member by two-color molding.

Effects of the Invention

According to the present invention, the mechanical pencil includes the first fixed cam and the second fixed cam with the upper and lower cam faces of the rotatable cam constituting the rotational drive mechanism for writing lead therebetween.

At least one of the first fixed cam and the second fixed cam has the cam face formed on the funnel-shaped inclined surface, and the cam face of the rotatable cam meshing with the cam face formed on the funnel-shaped inclined surface is formed on the conical inclined surface.

Therefore, the cam face of the rotatable cam formed on the conical inclined surface meshes with the cam face of the fixed cam formed on the funnel-shaped inclined surface. This realizes an ideal meshing state in which the axis of the rotatable cam aligns with the axis of the fixed cam, thereby to ensure smooth rotational drive operation of the rotational drive mechanism.

In another embodiment of the mechanical pencil according to the present invention, the first fixed cam and the second fixed cam are formed at the axially long elastic member molded integrally with the holder member constituting the rotational drive mechanism so as to face each other with the upper and lower cam faces of the rotatable cam therebetween. The second fixed cam at the tip portion of the elastic member is formed on the inclined surface bent at an obtuse angle from the longitudinal tip portion of the elastic member toward the axis of the holder member.

According to the foregoing configuration of the holder member, a metal mold (core pin) for molding components including the axially long elastic member and the first and second fixed cams can be axially removed. Specifically, to remove axially the core pin, the core pin can be pulled out by so-called forced extraction while deforming the elastic member toward the outside, without causing damage to the second fixed cam bent at an obtuse angle.

In addition, by forming the cam face of the lower cam in the rotatable cam meshing with the cam face of the second fixed cam on the conical inclined surface, it is possible to realize an ideal meshing state in which the axis of the rotatable cam aligns with the axis of the holder member, thereby to ensure smooth rotational drive operation of the rotational drive mechanism.

In addition, the first fixed cam is composed of a large number of cam faces continued in a circle, the cam faces are formed on the funnel-shaped inclined surface, and the cam face of the upper cam in the rotatable cam is formed on the conical inclined surface, which also realizes an ideal meshing state in which the axis of the first fixed cam and the axis of the upper cam align with each other.

At the time of injection molding of the holder member, the metal mold (core pin) can be axially removed, which allows the first fixed cam to include the large number of cam faces continued in a circle. This makes it possible to provide the rotational drive mechanism with further improved durability.

BEST MODE FOR CARRYING OUT THE INVENTION

Embodiments of a mechanical pencil according to the present invention will be described with reference to the accompanying drawings. It should be noted that, in each of the drawings described below, like parts or parts performing the same functions are referred to by like reference signs, but reference signs are assigned to typical parts in some drawings, and the detailed structures may be described with reference to reference signs used in other drawings for the sake of brevity.

First, FIGS. 1 to 10 illustrate a first embodiment of the mechanical pencil according to the present invention.

Figure 1:
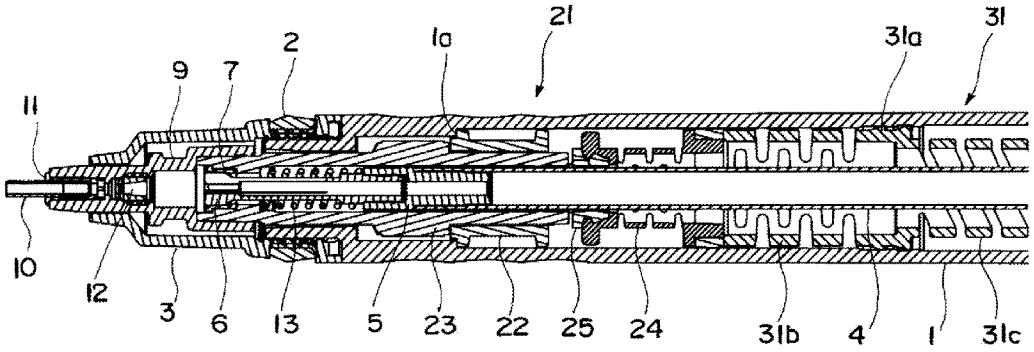
FIG. 1 is a sectional view of a front half section of a mechanical pencil in a first embodiment according to the present invention.
Figure 3:
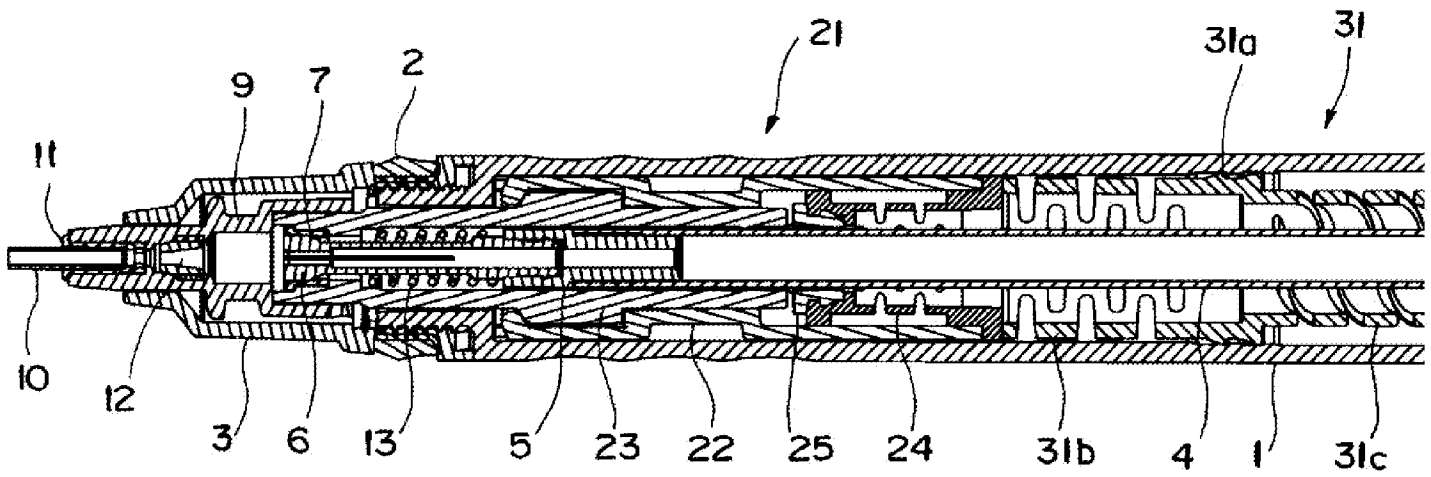
FIG. 3 is a sectional view of the front half section axially rotated 90 degrees from the state illustrated in FIG. 1.

As illustrated in FIGS. 1 and 3, a base member 3 with a decorative ring 2 is screwed into a tip portion of a body cylinder 1 and is detachably attached to the body cylinder 1. A cylindrical lead case 4 is accommodated in the body cylinder 1 along an axis thereof. A short lead case connector 5 is attached to a tip portion of the lead case 4 to which a brass chuck 6 is connected through the lead case connector 5.

The chuck 6 has a through hole (not shown) for writing lead formed therein along the axis. A tip portion of the chuck 6 is circumferentially divided into a plurality of pieces (three pieces, for example), and the divided tip pieces are loosely fitted in a brass ring-shaped clamp 7. The ring-shaped clamp 7 is fitted into a tip portion of a rotatable cam 23 constituting a portion of a rotational drive mechanism 21 surrounding the chuck 6.

A cylindrical slider 9 is accommodated in the base member 3 and is projected at a front end portion from the base member 3. The cylindrical slider 9 is fitted and attached to a front end portion of the rotatable cam 23 to surround the outer periphery of the rotatable cam 23. A pipe end 10 for guiding a writing lead is attached to the front end portion of the slider 9 via a pipe holder 11.

A rubber holder chuck 12 with a through hole formed at an axial portion is attached immediately behind the pipe holder 11 on the inner periphery of the slider 9.

According to the foregoing configuration, a linear lead inserting hole is formed to reach the pipe end 10 via the through hole formed in the chuck 6 linked to the lead case 4 and via the through hole formed along the axis of the holder chuck 12. A writing lead (not shown) is inserted into this linear lead inserting hole. Further, a coil-like chuck spring 13 is provided between the rotatable cam 23 and the lead case connector 5.

That is to say, the front end portion of the chuck spring 13 abuts an annular step portion on an inner periphery of the rotatable cam 22, and the rear end portion of the chuck spring 13 is accommodated in abutment with the front end face of the lead case connector 5. Therefore, the chuck 6 is moved backward in the rotatable cam 22 by the axial extending action of the chuck spring 13, and is biased in a direction in which its tip portion is accommodated in the ring-shaped clamp 7, i.e., in a direction in which the writing lead is gripped.

The outer part of the rotational drive mechanism 21 for writing lead including the rotatable cam 23 is formed by a holder member 22. The cylindrical rotatable cam 23 is rotatably attached to the holder member 22. A rubber cushion member 24 is attached to the holder member 22. A slip member (hereinafter, referred to as also torque canceller) 25 is attached to the cushion member 24 to slip between the cushion member 24 and the rotatable cam.

The torque canceller 25 comes into abutment with the rear end portion of the rotatable cam 23 and acts to push out the rotatable cam 23 forward in the axial direction by the elasticity of the cushion member 24.

It should be noted that inner peripheries of the rotatable cam 23, the cushion member 24, and the torque canceller 25 provide a space through which the lead case 4 passes, whereby the lead case 4, the chuck 6, and others are individually movable in the axial direction.

The rotational drive mechanism 21 is provided with the holder member 22, the rotatable cam 23, the cushion member 24, the torque canceller 25, and the like, which are made into a unit. A structure of the unit of the rotational drive mechanism 21 will be described later in detail with reference to FIGS. 5 to 10.

The mechanical pencil including the rotational drive mechanism 21 keeps the not illustrated writing lead gripped by the rotatable cam 23 and the chuck 6 by the action of the cushion member 24, in a state that is axially moved forward.

When writing pressure is applied to the writing lead by the user's writing action, the writing lead and the chuck 6 and the rotatable cam 23 gripping the writing lead are slightly moved backward to compress the cushion member 24 in the axial direction. At the moment of release of the writing lead form the writing surface (paper surface), the rotatable cam 23 and the chuck 6 are slightly moved forward by restoring action of the cushion member 24.

That is, the rotational drive mechanism 21 functions such that, upon the slight backward movement and forward movement (cushioning action) of the writing lead by the writing action via the chuck 6, the rotatable cam 23 is rotated in one direction, and the rotational motion is transferred to the chuck 5 to drive rotationally the writing lead not illustrated gripped by the chuck 5.

The rotational drive mechanism 21 as a unit is pressed forward and positioned in the body cylinder 1 by an eraser cradle 31 inserted from the rear end portion of the body cylinder.

Figure 2:
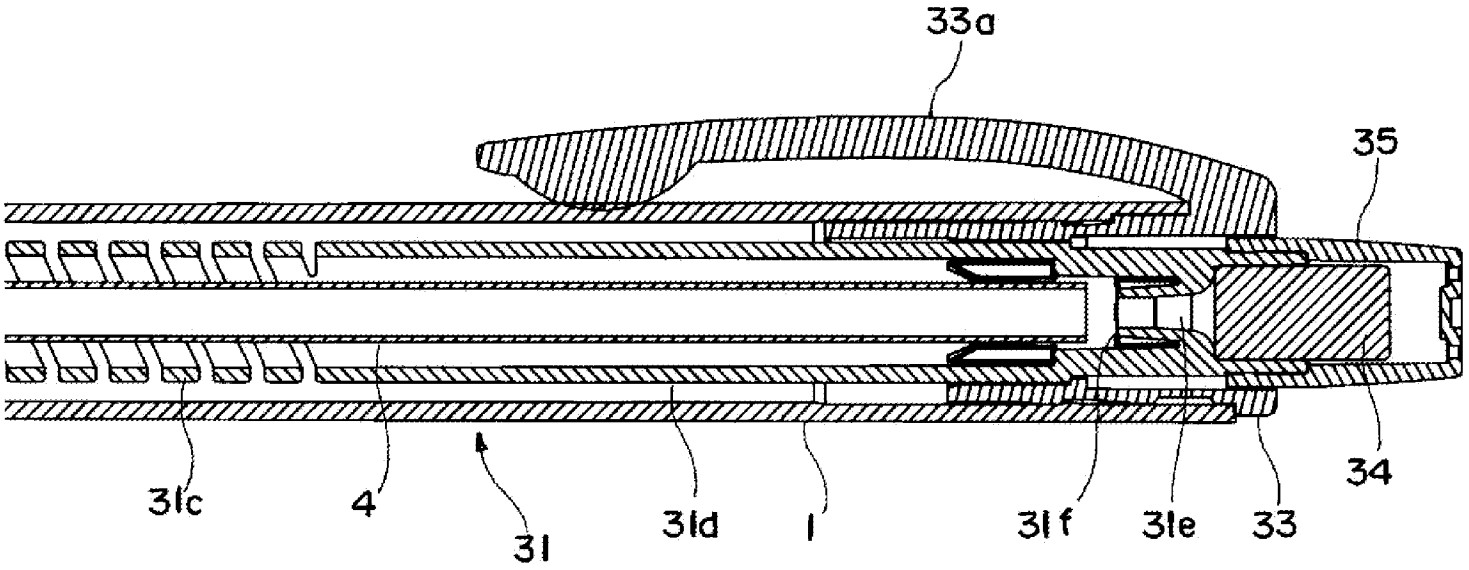
FIG. 2 is a sectional view of a rear half section continued from FIG. 1.
Figure 4:
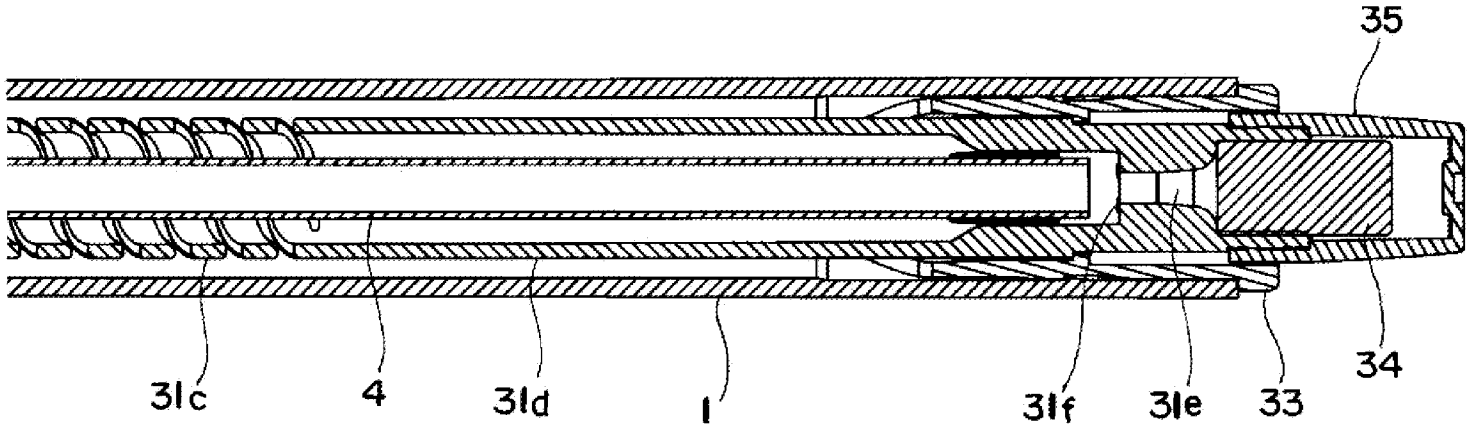
FIG. 4 is a sectional view of the rear half section continued from FIG. 3.

The eraser cradle 31 constitutes an entirely longitudinal cylindrical body as illustrated in FIGS. 2 and 4. The eraser cradle 31 has a circular undercut part 31*a* near its front end portion. The undercut part 31*a* is fitted and fixed in the body cylinder 1.

The front portion of the undercut part 31*a* is formed like an accordion with a plurality of circumferential slits, thereby to constitute a first spring body 31*b*. The back portion of the undercut part 31*a* is formed in a spiral. The spiral structure constitutes a second spring body 31*c*. The back portion of the second spring body 31*c* constitutes a cylindrical body 31*d*. An eraser described later is attached to the end portion of the cylindrical body 31*d*.

When the undercut part 31*a* of the eraser cradle 31 is fitted into the body cylinder 1, the eraser cradle 31 is fixed in the body cylinder as described above. The eraser cradle 31 acts such that the first spring body 31*b* at the front portion of the undercut part 31*a* pushes forward the rotational drive mechanism 21 as a unit. When the rotational drive mechanism 21 comes into partial abutment with a step portion 1*a* formed by reducing the diameter of the body cylinder 1 as illustrated in FIG. 1, the rotational drive mechanism 21 is positioned and attached in the body cylinder 1.

As illustrated in FIGS. 2 and 4, at the rear end portion of the body cylinder 1, a cylindrical clip support body 33 with an integrally formed clip 33*a* is fitted and attached to the inner periphery of the body cylinder 1. An eraser 34 is detachably attached to the rear end portion of the eraser cradle 31 projected slightly more backward than the clip support body 33. A knock cover 35 covering the eraser 34 is detachably attached to the peripheral surface of the read end portion of the eraser cradle 31.

A writing lead feeding hole 31*e* with a small diameter is formed at the position of attachment of the eraser 34 in the eraser cradle 31. An abutting portion 31*f* is formed at immediate front of the writing lead feeding hole 31*e* in a direction orthogonal to the axis. The abutting portion 31*f* formed at the eraser cradle 31 and the read end portion of the lead case 4 face each other with a predetermined axial spacing therebetween.

According to this configuration, even when the chuck 6 and the lead case 4 are slightly moved backward by the cushioning action at the time of writing, the rear end portion of the lead case 4 does not collide against the abutting portion 31*f* at the eraser cradle, which prevents interference with the rotational motion of the rotational drive mechanism 21.

In the foregoing configuration, as the knock cover 35 is knocked, the second spring body 31*c* of the eraser cradle 31 is contracted and the abutting portion 31*f* of the eraser cradle 31 pushes the lead case 4 forward.

Accordingly, the chuck 6 is moved forward to push the slider 9 slightly forward. However, the slider 9 comes into partial abutment with the base member 3 to interfere with the forward movement. Therefore, the tip portion of the chuck 6 projects relatively from the clamp 7 to release the writing lead from the state of being gripped by the chuck 6.

Then, when the knock operation is stopped, the knock cover 35 is moved backward by the action of the second spring body 31*c* of the eraser cradle 31, and the chuck 6 and the lead case 4 are also moved backward in the body cylinder by the action of the chuck spring 13.

At this time, the writing lead is temporarily held by friction in the through hole in the holder chuck 12. In this situation, as the chuck 6 is moved backward, its tip portion is accommodated in the clamp 7, whereby the writing lead turns again into the gripped state.

That is to say, as the chuck 6 is moved forward and backward by repeatedly knocking the knock cover 35, the writing lead is gripped and released, whereby the writing lead is gradually fed forward from the chuck 6.

Figure 8:
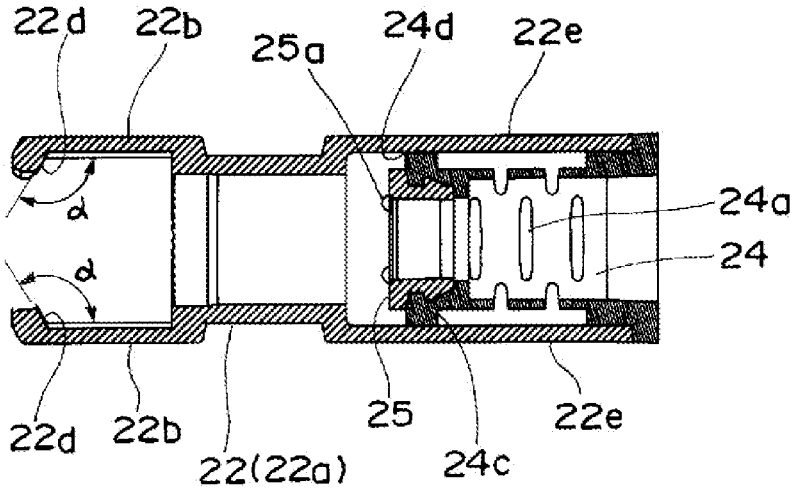
FIG. 8 is a sectional view of the holder member in FIG. 5 taken in the axial direction.
Figure 9:
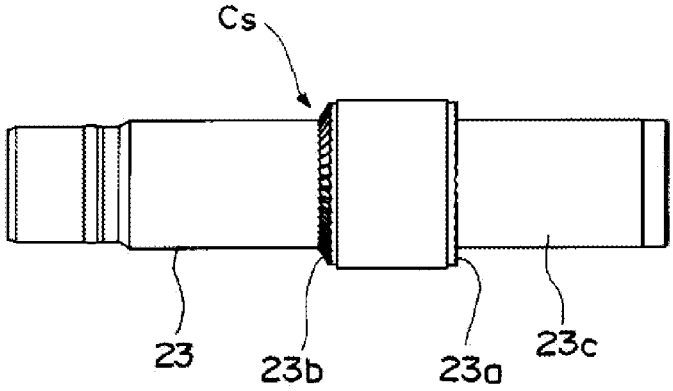
FIG. 9 is a front view of a rotatable cam in the rotational drive mechanism included in the mechanical pencil illustrated in FIGS. 1 to 4.
Figure 10:
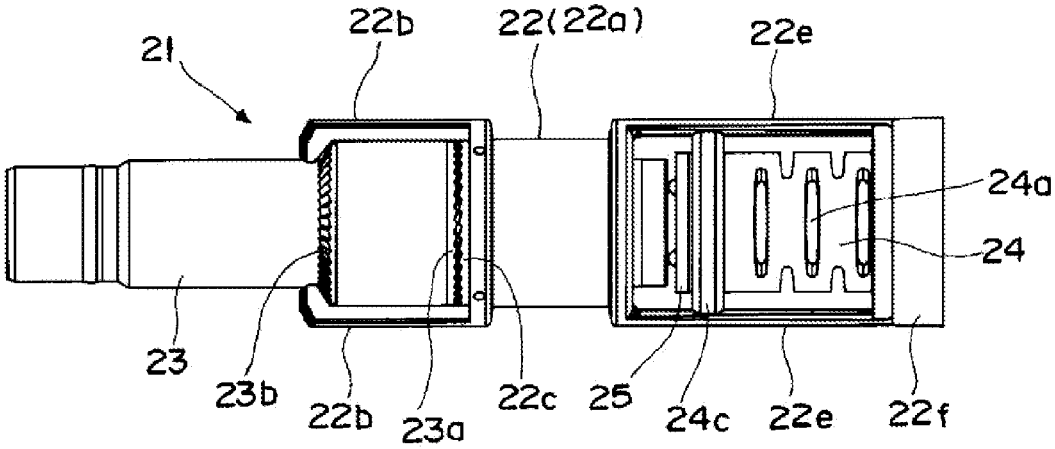
FIG. 10 is a perspective view of the rotational drive mechanism with the rotatable cam illustrated in FIG. 9 attached to the holder member.

FIGS. 5 to 10 illustrate the rotational drive mechanism 21 for writing lead according to the first embodiment. FIGS. 5 to 8 represent a half-finished unit state without the rotatable cam, and FIG. 10 represents a finished unit state with the rotatable cam mounted.

As illustrated in the drawings, the holder member 22 constitutes the outer part of the rotational drive mechanism 21 and includes a cylindrical portion 22*a* in the center thereof. An inner periphery of this cylindrical portion 22*a* functions to support the rotatable cam 23 so as to be rotatable and axially movable.

A pair of axially long elastic members 22*b* is formed at the positions symmetrical about the axis, on one end portion side of the cylindrical portion 22*a*, i.e. on the front end side in a situation where the rotational drive mechanism 21 is mounted in the body cylinder 1. By way of resin molding, the pair of elastic members 22*b* is formed integrally with the central cylindrical portion 22*a* and is made long and slender to give elastic property.

Further, a large number of sawtooth cam faces (hereinafter, referred to also as first fixed cam) 22*c* is continuously formed in a circle on a base end portion of the pair of elastic members 22*b*, that is, on an end surface of the cylindrical portion 22*a*.

Furthermore, by way of resin molding, sawtooth cams (hereinafter, referred to as second fixed cams) 22*d* are formed integrally with the pair of elastic members 22*b* at the tip portions thereof, so as to face the first fixed cam 22*c*.

Figure 5:
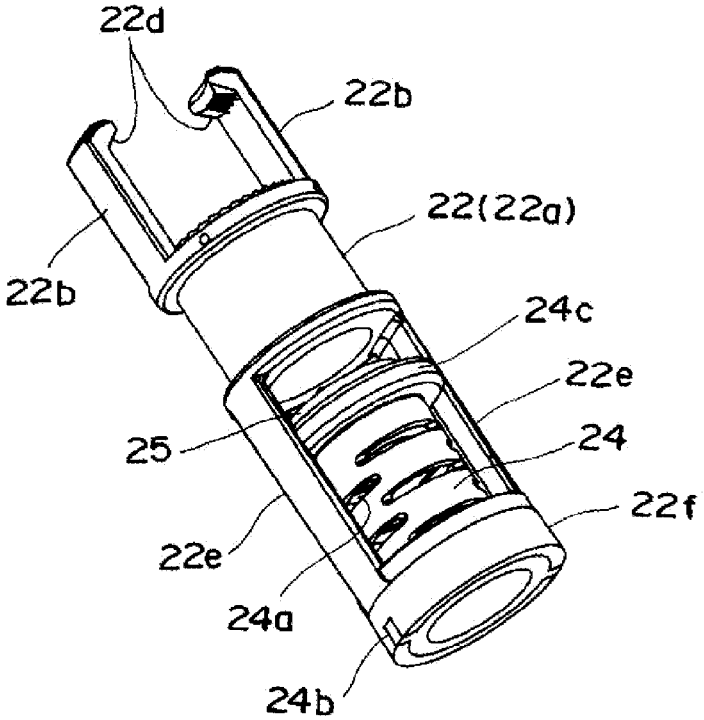
FIG. 5 is a perspective view of a holder member in a rotational drive mechanism included in the mechanical pencil illustrated in FIGS. 1 to 4.
Figure 6:
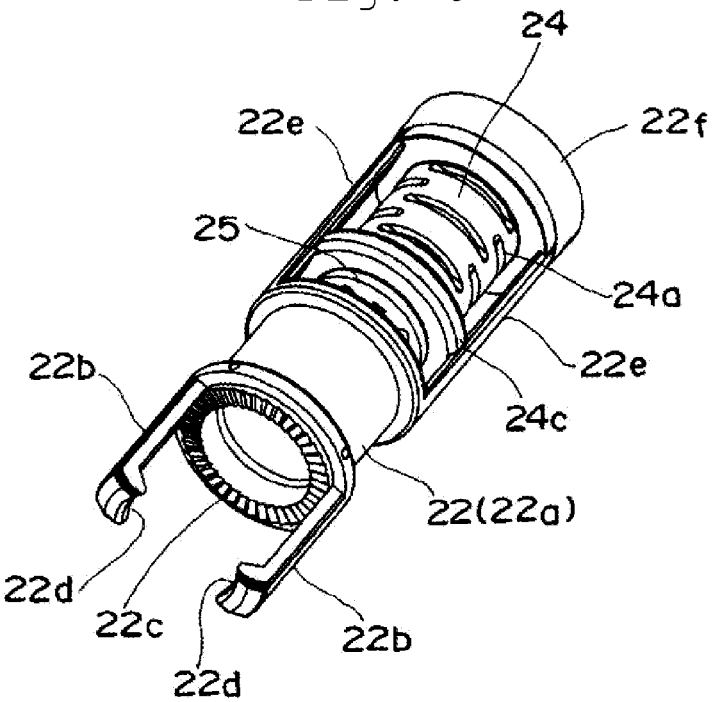
FIG. 6 is a perspective view of a vertically flipped state of the holder member illustrated in FIG. 5.

Each of the second fixed cams 22*d* has a cam face with a small number of saw teeth to be formable within the width of the elastic member 22*b*, as illustrated in FIG. 5.

The cam faces of the second fixed cams 22*d* are formed on inclined surfaces bent at an obtuse angle from the longitudinal tip portions of the elastic members 22*b* toward the axis, as illustrated in FIG. 8. That is, the cam faces of the second fixed cams 22*d* are formed at an angle (obtuse angle) indicated with a relative to the longitudinal sides of the elastic members 22*b*, as illustrated in FIG. 8.

At the other end side of the central cylindrical portion 22*a*, i.e., at the rear end side in a situation where the rotational drive mechanism 21 is mounted in the body cylinder, a pair of axially extending columnar bodies 22*e* is formed axisymmetrically, and a ring member 22*f* is formed by way of resin molding integrally with the cylindrical portion 22*a* via the columnar bodies 22*e*.

The rubber cushion member 24 is mounted by means of the ring member 22*f*, and the resin torque canceller 25 is attached through the cushion member 24.

The cushion member 24 is formed in a cylindrical shape, and a plurality of slits 24*a* is circumferentially formed at the cylindrical portion of the cushion member 24, thereby increasing axial resiliency of the cushion member 24.

In this embodiment, the rubber cushion member 24 is integrally formed between the ring member 22*f* and the torque canceller 25, by two-color molding using a rubber material such as an elastomer. It should be noted that a portion with reference sign 24*b* in FIG. 5 indicates a gate position for injecting the rubber material at the time of two-color molding.

Figure 7:
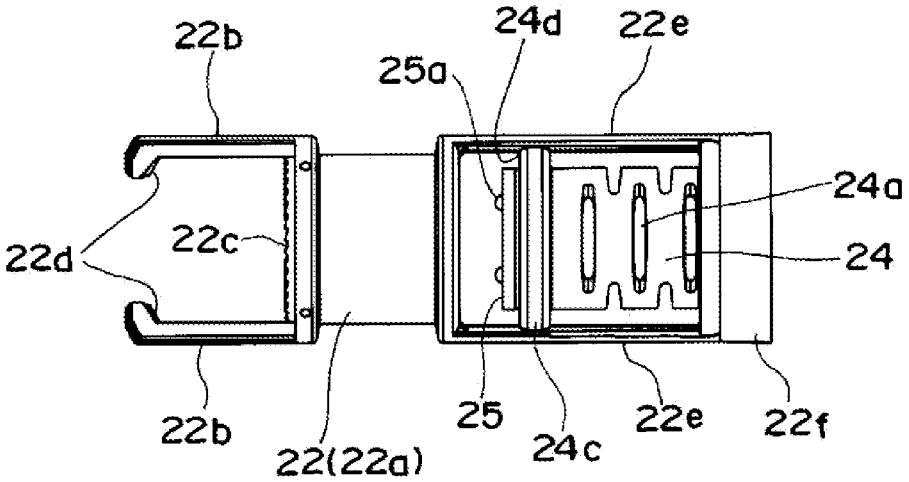
FIG. 7 is a front view of the holder member illustrated in FIG. 5.

The torque canceller 25 has a plurality of hemispherical projections 25*a* along the side opposite to the cushion member 24, as illustrated in FIGS. 7 and 8. The projections 25*a* is brought into abutment with the rear end portion of the rotatable cam 23 described later by the elastic action of the cushion member 24 to push the rotatable cam 23 forward, and functions to cause slippage on the rear end portion of the rotatable cam 23.

As illustrated in FIGS. 7 and 8, a flange portion 24*c* projecting circularly in the direction orthogonal to the axis is integrally formed with the cushion member 24, just proximal to the torque canceller 25 in the cushion member 24. The flange portion 24*c* has concave guide portions 24*d* at positions facing the pair of columnar bodies 22*e*. As the rotatable cam 23 moves axially backward, the concave guide portions 24*d* move along the longitudinal sides (axial sides) of the pair of columnar bodies 22*e*.

FIG. 9 illustrates a single configuration of the rotatable cam 23. The rotatable cam 23 is formed in a cylindrical shape. The rotatable cam 23 is larger in diameter at the middle portion, and has cams 23*a* and 23*b* with a large number of saw teeth continued in a circle on upper and lower end surfaces orthogonal to the axis of the large-diameter portion. Hereinafter, one of the cams will be referred to as upper cam 23*a*, and the other as lower cam 23*b*.

In the embodiment, the rotatable cam 23 has the upper cam 23*a* with a large number of sawtooth cams continuously formed in a circle on the surface orthogonal to the axis, as illustrated in FIG. 9.

The rotatable cam 23 has the lower cam 23*b* with a large number of sawtooth cams continuously formed in a circle on a conical inclined surface Cs from the middle large-diameter portion to the small-diameter portion. The small-diameter portion of the rotatable cam 23 at the front end constitutes a rotation axis 23*c* when being attached to the holder member 22.

FIG. 10 illustrates the state where the rotatable cam 23 is attached to the holder member 22 described above. To assemble the rotatable cam 23 into the holder member 22, the rotation axis 23*c* of the rotatable cam 23 is pressed into the cylindrical portion 22*a* of the holder member 22 from the side of the pair of elastic members 22*b* at the holder member 22. Thus, the pair of elastic members 22*b* is pressed apart to allow the rotation axis 23*c* to be accommodated in the cylindrical portion 22*a*. Accordingly, the rotational drive mechanism 21 can be formed.

The cam faces of the first fixed cam 22*c* in the holder member 22 constituting the rotational drive mechanism 21 are formed on the end surface of the cylindrical portion 22*a* of the holder member 22 orthogonal to the axis as described above. The cam surfaces of the upper cam 23*a* in the rotatable cam 23 are also formed on a surface orthogonal to the axis. Therefore, the both cam faces can axially mesh each other without problem.

The cam faces of the second fixed cams 22*d* in the holder member 22 constituting the rotational drive mechanism 21 are formed at an obtuse angle (angle $\alpha$) relative to the longitudinal sides of the elastic members 22*b* as described above. The cam faces of the lower cam 23*b* in the rotatable cam 23 are formed on the conical inclined surface Cs.

The angle $\alpha$ of the second fixed cams 22*d* and the conical inclined surface Cs of the rotatable cam 23 axially match each other. Therefore, the second fixed cams 22*d* and the lower cam 23*b* can axially mesh with each other without problem.

According to the thus configured rotational drive mechanism 21 for writing lead, while the chuck 6 grips the writing lead as illustrated in FIGS. 1 and 3, the rotatable cam 23 is rotatable with the chuck 6 around the axis. When the mechanical pencil is not used, the rotatable cam 23 is biased forward via the torque canceller 25 by the action of the rubber cushion member 24 arranged in the rotational drive mechanism 21.

Meanwhile, when the mechanical pencil is used in writing, that is, when writing pressure is applied to the writing lead projecting from the pipe end 10, the chuck 6 is moved backward against the biasing force of the cushion member 24, and the rotatable cam 23 is also slightly moved backward in the axial direction. Therefore, the upper sawtooth cam 23*a* formed in the rotatable cam 23 joins to and meshes with the first fixed cam 22*c*.

In this case, the upper cam 23*a* and the first fixed cam 22*c* facing each other are axially shifted from each other by a half-phase (half-pitch) per cam tooth. When the upper cam 23*a* and the first fixed cam 22*c* join to and mesh with each other as described above, the rotatable cam 23 is rotationally driven by a half-phase (half-pitch) per tooth of the upper cam 23*a*.

When the upper cam 23*a* and the first fixed cam 22*c* join to and mesh with each other as described above, the cam faces of the lower sawtooth cam 23*b* and the second fixed cams 22*d* facing each other are axially shifted from each other by a half-phase (half-pitch) per cam tooth.

Therefore, when one stroke of writing is completed and the writing pressure is released from the writing lead, the rotatable cam 23 is slightly pushed forward in the axial direction by the action of the cushion member 24. Thus, the lower cam 23*b* of the rotatable cam 23 meshes with the second fixed cams 22*d*. Accordingly, the rotatable cam 23 is rotationally driven again in the same direction by a half-phase (half-pitch) per tooth of the lower cam 23*b*.

As described above, according to the mechanical pencil, as the rotatable cam 23 is axially moved forward and backward under the writing pressure, the rotatable cam 23 is rotationally driven by one tooth (one pitch) of the upper cam 23*a* and the lower cam 23*b*. The writing lead gripped by the chuck 6 is also rotationally driven in one direction.

Therefore, the tip portion of the writing lead is always kept in a conical shape by its rotational motion and writing wear. This makes it possible to prevent the writing lead from being worn in an imbalanced manner during the progress of writing, and realize writing with a stable line width.

According to the first embodiment described above, the cam faces of the second fixed cams 22*d* constituting the rotational drive mechanism 21 are bent at an obtuse angle from the longitudinal sides of the elastic members 22*b* toward the axis, and the cam face of the lower cam 23*b* of the rotatable cam 23 meshing with the cam faces of the second fixed cams 22*d* is formed on the conical inclined surface Cs. Accordingly, the rotatable cam 23 axially meshes with the second fixed cams 22*d* to realize an ideal meshing state in which the axis of the rotatable cam 23 aligns with the axis of the holder member 22. This produces the advantageous effects as described above in the section of the effect of the invention, such as ensuring smooth rotational drive operation of the rotational drive mechanism.

Figure 11:
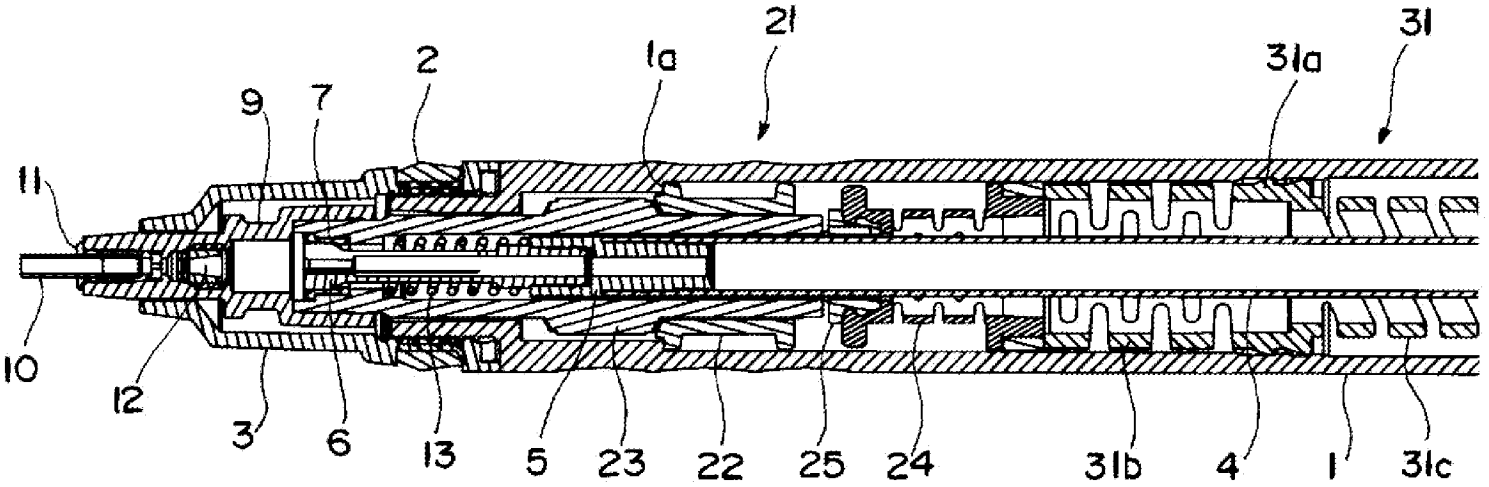
FIG. 11 is a sectional view of a front half section of a mechanical pencil in a second embodiment of the present invention.

Next, FIGS. 11 to 17 illustrate a second embodiment of the mechanical pencil according to the present invention. FIG. 11 is a sectional view of a front half portion of the mechanical pencil. The configuration illustrated in FIG. 11 is equivalent to the configuration illustrated in FIG. 1 according to the first embodiment described above, and components performing the same functions as those of the components illustrated in FIG. 1 are given the same reference signs as those in FIG. 1. Therefore, detailed descriptions thereof will be omitted here. A second half portion of the mechanical pencil continued from FIG. 11 is the same in configuration as that illustrated in FIG. 2.

FIGS. 12 to 17 illustrate a configuration of the rotational drive mechanism 21 for writing lead according to the second embodiment. These drawings are equivalent to FIGS. 5 to 10 according to the first embodiment. Components performing the same functions as those of the components described in FIGS. 5 to 10 are given the same reference signs as those in FIGS. 5 to 10, and detailed descriptions thereof will be omitted here.

Therefore, descriptions will be given hereinafter only as to the features of the second embodiment.

Figure 13:
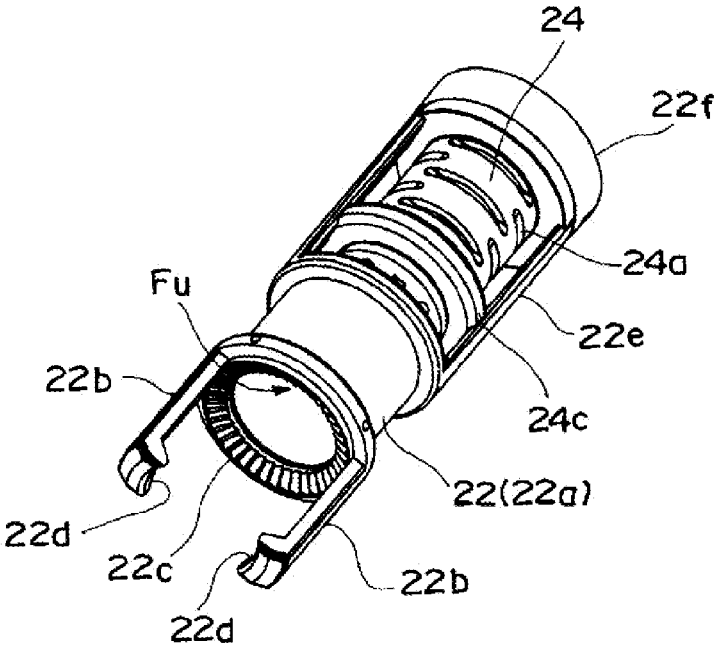
FIG. 13 is a perspective view of a vertically flipped state of the holder member illustrated in FIG. 12.
Figure 14:
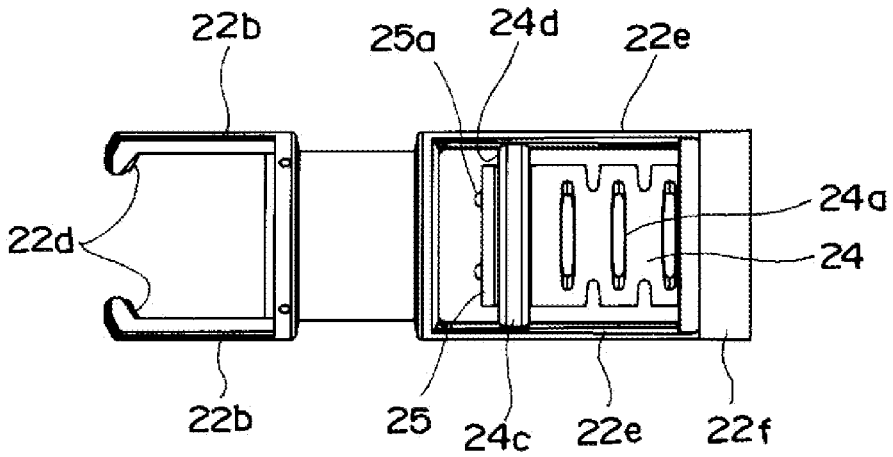
FIG. 14 is a front view of the holder member illustrated in FIG. 12.
Figure 15:
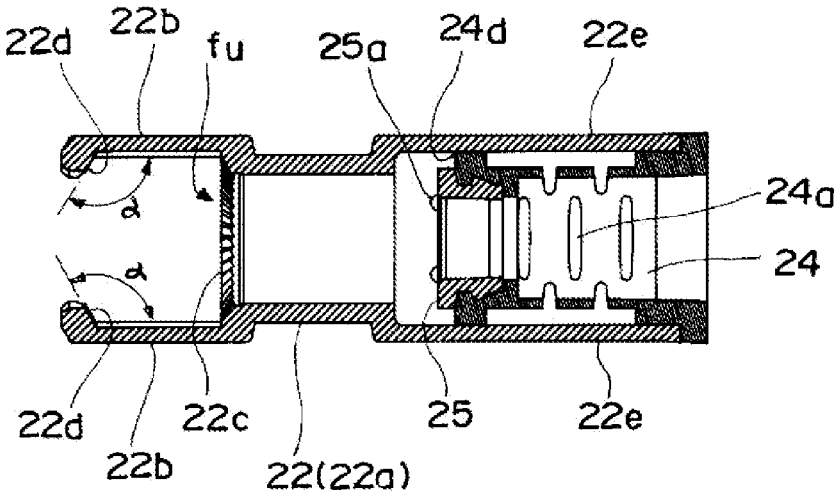
FIG. 15 is a sectional view of the holder member illustrated in FIG. 14 taken in the axial direction.

In the second embodiment, as described in FIGS. 13 and 15 in particular, the holder member 22 has a first fixed cam 22*c* with a large number of sawtooth cams continued in a circle at the cylindrical portion 22*a*. The cam face of the first fixed cam 21*c* is formed on a funnel-shaped inclined surface Fu.

The cam faces of the second fixed cams 22*d* are formed on inclined surfaces bent at an obtuse angle α from the longitudinal tip portions of the elastic members 22*b* toward the axis as illustrated in FIG. 15, which is the same as in the first embodiment described above.

Figure 16:
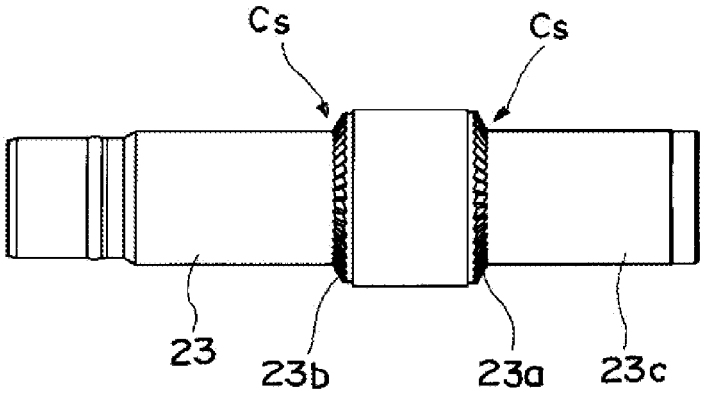
FIG. 16 is a front view of a rotatable cam in the rotational drive mechanism included in the mechanical pencil illustrated in FIG. 11.
Figure 17:
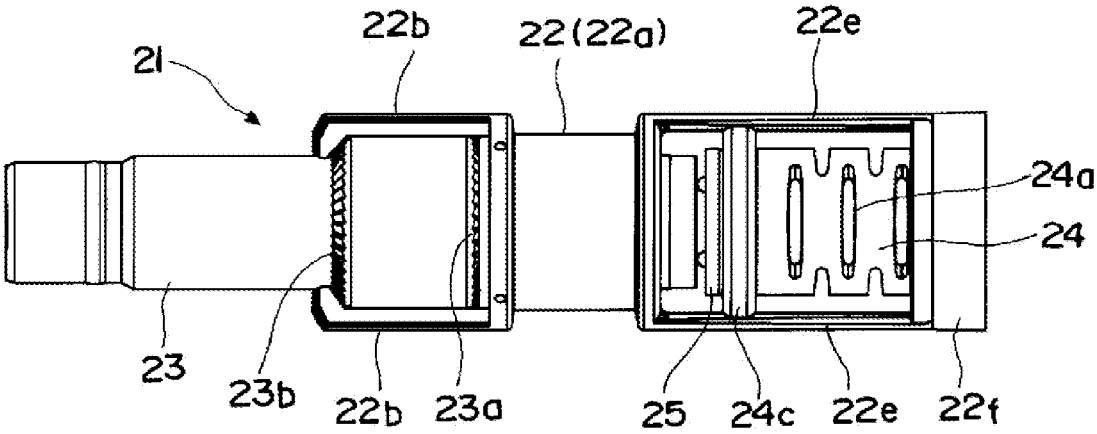
FIG. 17 is a perspective view of the rotational drive mechanism with the rotatable cam illustrated in FIG. 16 attached to the holder member.

Meanwhile, the cam face of the upper cam 23*a* in the rotatable cam 23 meshing with the first fixed cam 22*c* is formed on a conical inclined surface as illustrated in FIG. 16.

That is, FIG. 16 illustrates a single configuration of the rotatable cam 23 according to the second embodiment. In the second embodiment, the upper cam 23*a* and the lower cam 23*b* have a large number of sawtooth cams continued in a circle on the conical inclined surfaces Cs from the middle large-diameter portion to the small-diameter portions on the both sides.

The funnel-shaped inclined surface Fu of the first fixed cam 22*c* and the conical inclined surface Cs of the upper cam 23*a* in the rotatable cam 23 align with each other in the axial direction. Therefore, the first fixed cam 22*c* and the upper cam 23*a* can axially mesh with each other without problem. In addition, the inclined angle α of the cam faces of the second fixed cams 22*d* and the conical inclined surface Cs of the lower cam 23*b* in the rotatable cam 23 align with each other in the axial direction. Therefore, the second fixed cams 22*d* and the lower cam 23*b* can axially mesh with each other without problem, which is the same as in the first embodiment described above.

According to the second embodiment described above, the cam face of the first fixed cam 22*c* constituting the rotational drive mechanism 21 is formed on the funnel-shaped inclined surface Fu, and the cam face of the upper cam 23*a* in the rotatable cam 23 meshing with the cam face of the first fixed cam 22*c* is formed on the conical inclined surface. In addition, the cam faces of the second fixed cams 22*d* are formed on the inclined surfaces bent at an obtuse angle from the longitudinal tip portions of the elastic members 22*b* toward the axis, and the cam face of the lower cam 23*b* in the rotatable cam 23 meshing with the cam faces of the second fixed cams 22*d* is formed on the conical inclined surface. This realizes an ideal meshing state in which the axis of the rotatable cam 23 aligns with the axis of the holder member 22 in each of the axial directions.

Accordingly, it is possible to obtain the same advantageous effects as described above in the section of the effect of the invention, such as ensuring more smooth rotational drive operation of the rotational drive mechanism as compared to the first embodiment.

Figure 12:
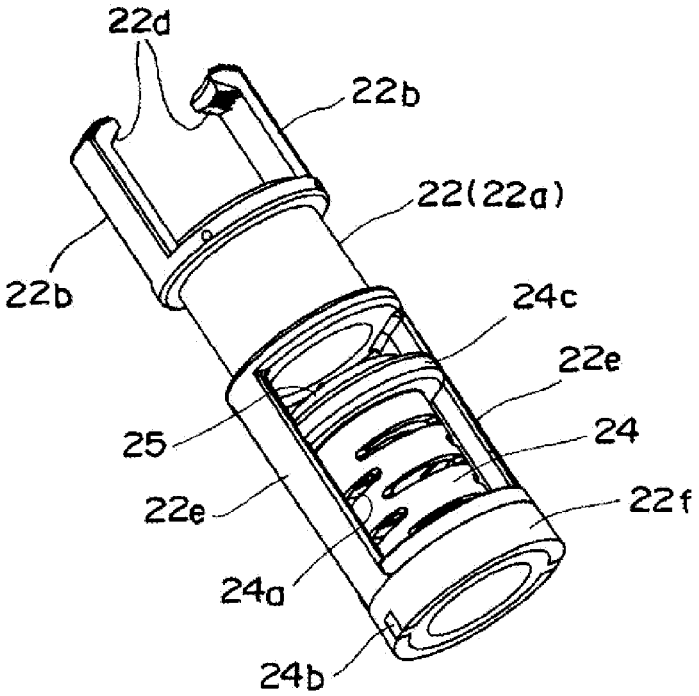
FIG. 12 is a perspective view of a holder member in a rotational drive mechanism included in the mechanical pencil illustrated in FIG. 11.

At the rotational drive mechanism 21 for writing lead used in the first and second embodiments, the second fixed cams 22*d* formed in the holder member 22 have cam faces with a small number of saw teeth to be formable within the widths of the elastic members 22*b* as illustrated in FIGS. 5 and 12, for example.

According to this configuration, it has been verified that, when the metal mold (core pin) for molding the axially long elastic members 22*b* and the second fixed cams 22*d* at the tip portions of the elastic members 22*b* is axially removed by the forced extraction as described above, the removal may cause partial scratches on the cam faces of the second fixed cams 22*d*.

This problem is presumed to occur because the sawtooth cams in the second fixed cams 22*d* have radial ridge lines, and the portions of the core pin corresponding to the ridge lines are relatively displaced and removed in parallel to the ridge lines.

Meanwhile, at the rotational drive mechanism 21, the second fixed cams 22*d* are formed on the inclined surfaces bent at an obtuse angle from the longitudinal tip portions of the elastic members 22*b*, which causes a problem that the axial position of the rotatable cam 23 is not stable.

This is because the axial position of the rotatable cam 23 is determined by the balance between the biasing force of the rubber cushion member 24 for pushing the rotatable cam 23 forward and the restoring force of the pair of the elastic members 22*d* when being extended outward.

Therefore, variations in the axial position of the rotatable cam 23 lead to variations in projecting dimension of the slider 9 and the pipe end 10 connected to the rotatable cam 23 from the base member 3.

FIGS. 18 to 23 illustrate a configuration of the rotational drive mechanism 21 for writing lead according to a third embodiment that is revised to solve the foregoing technical problems. In FIGS. 18 to 23, components performing the same functions as those of the first embodiment described above are given the same reference signs as those of the first embodiment, and detailed descriptions thereof will be omitted here. Therefore, descriptions will be hereinafter given only as to the features of the third embodiment.

Figure 18:
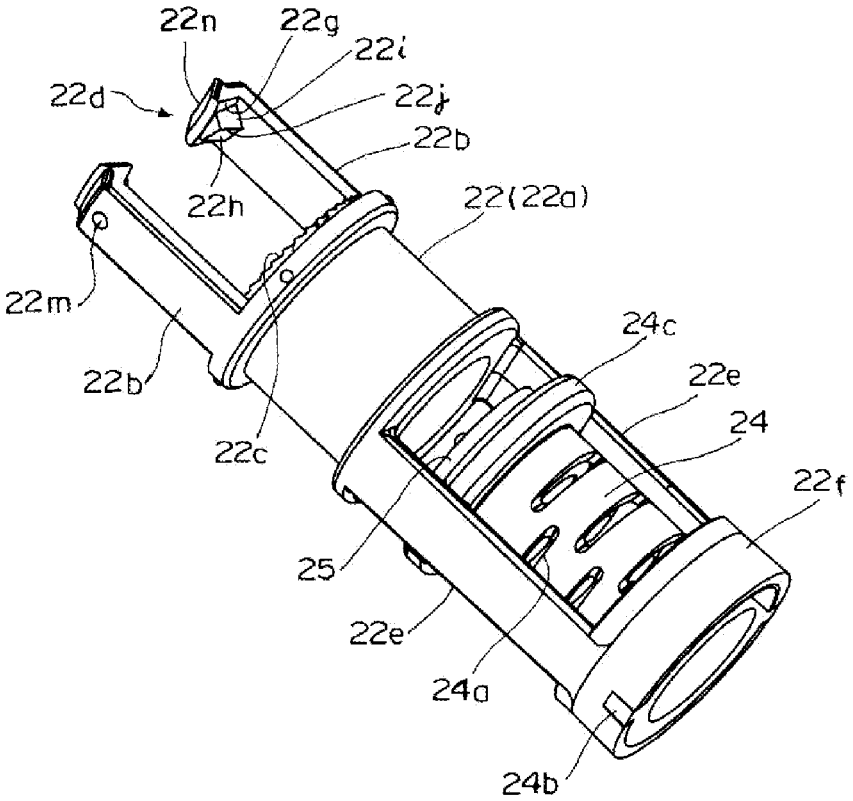
FIG. 18 is a perspective view of a holder member in a rotational drive mechanism for use in a mechanical pencil in a third embodiment of the present invention.
Figure 21:
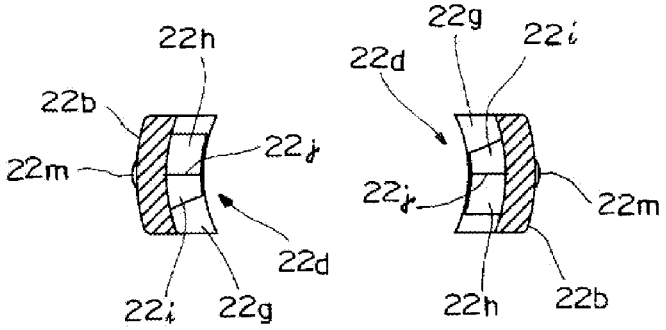
FIG. 21 is an enlarged sectional view of an elastic member taken along line B-B in the direction of arrows in FIG. 20.

In the third embodiment, each of the second fixed cams 22*d* is composed of one sawtooth cam formed on an inclined surface 22*g* bent at an obtuse angle from the longitudinal tip portion of the elastic member 22*b* toward the axis as illustrated in FIGS. 18 and 21.

Each of the sawtooth cams (the second fixed cams 22*d*) is formed in the shape of a saw tooth in which two cam faces 22*h* and 22*i* cross each other at one ridge line 22*j* and an extended line of the ridge line 22*j* is directed toward the axis of the holder member 22.

According to the configuration of the second fixed cams 22*d*, when the core pin for resin-molding the second fixed cams 22*d* is axially removed by the forced extraction as described above, the portions of the core pin corresponding to the ridge lines are relatively displaced and removed along the longitudinal sides of the ridge lines 22*j* of the fixed cams 22*d*.

Therefore, it is possible to solve the problem of causing damage to the second fixed cams 22*d* such as making scratches on the cam faces at the time of removal of the core pin.

Figure 22:
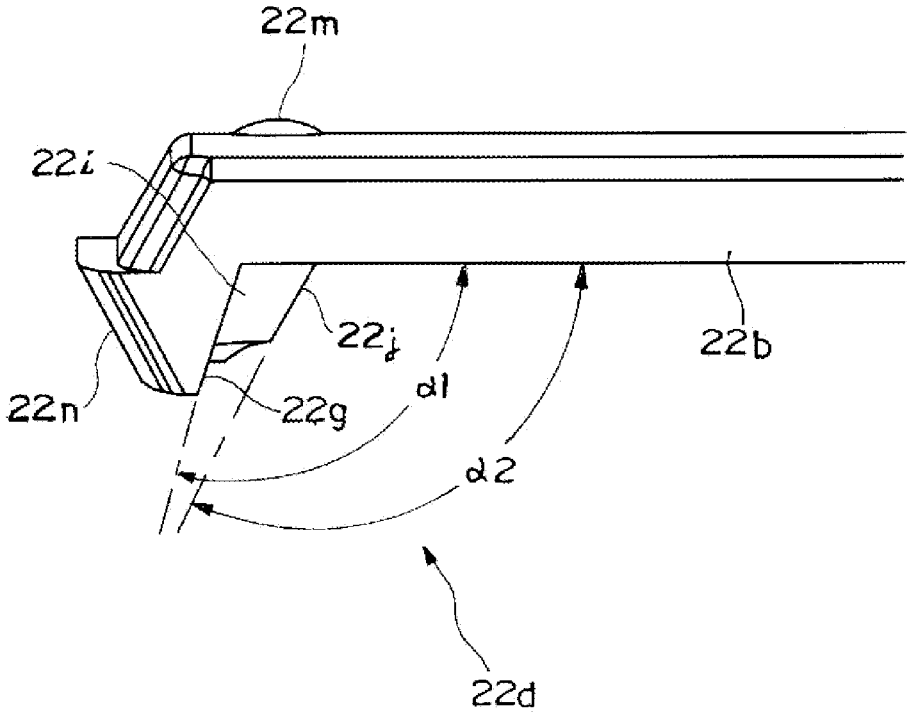
FIG. 22 is an enlarged view of a portion A surrounded by a chain line in FIG. 19.

Further, in the third embodiment, as illustrated in the partially enlarged view of FIG. 22, each of the second fixed cams 22*d* is formed on the inclined surface 22*g* bent at an obtuse angle from the longitudinal tip portion of the elastic member 22*b* toward the axis, and a specific angle is formed by the inclined surface 22*g* and the ridge line 22*j* of the second fixed cam 22*d*.

Specifically, each of the second fixed cams 22*d* is formed to meet the relationship $\alpha 1<\alpha 2$ where the angle formed by the inclined surface 22*g* and the line directed toward the longitudinal tip portion of the elastic member 22*b* is designated as angle $\alpha 1$ and the angle formed by the cam ridge line 22*j* of the second fixed cam 22*d* and the line directed toward the longitudinal tip portion of the elastic member 22*b* is designated as angle $\alpha 2$.

According to the foregoing configuration of the second fixed cams 22*d*, when the core pin for resin-molding the second fixed cams 22*d* is axially removed by the forced extraction, the core pin comes into axial abutment with the inclined surfaces 22*g* at the smaller obtuse angle $\alpha 1$ to press the elastic members 22*b* apart outward. Therefore, the second fixed cams 22*d* act to separate immediately from the core pin, which makes it possible to solve the problem of making scratches on the cam faces of the second fixed cams 22*d* at the time of removal of the core pin.

Figure 23:
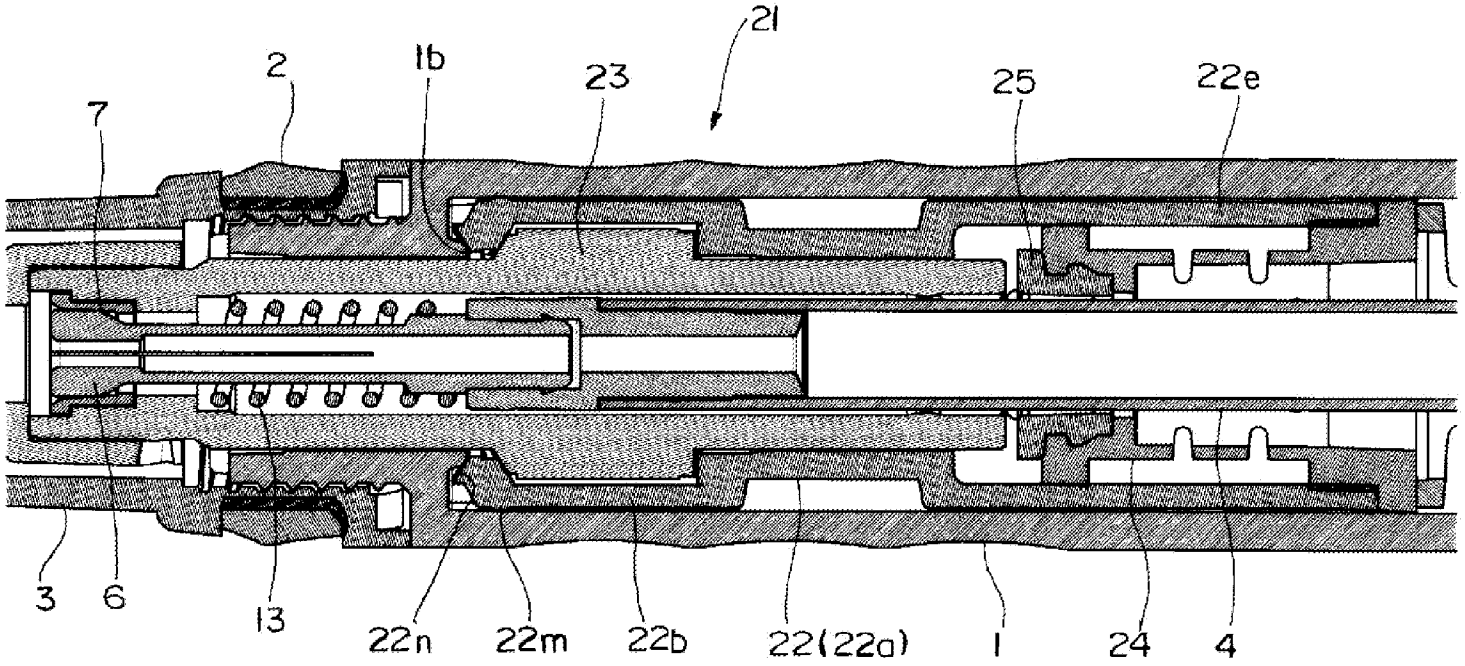
FIG. 23 is an enlarged sectional view of the rotational drive mechanism in the mechanical pencil in the third embodiment.
Figure 24:
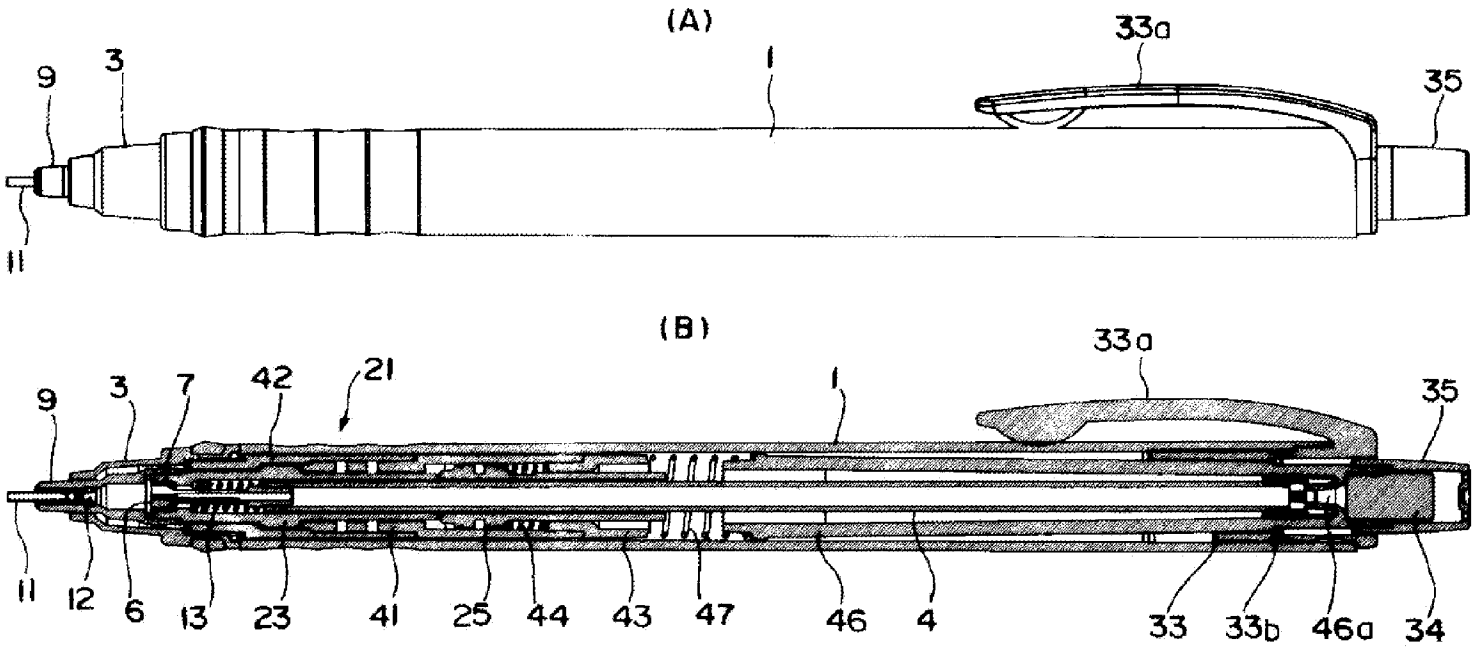
FIGS. 24(A) and 24(B) include an outline view and a sectional view of a mechanical pencil in a fourth embodiment.
Figure 25:
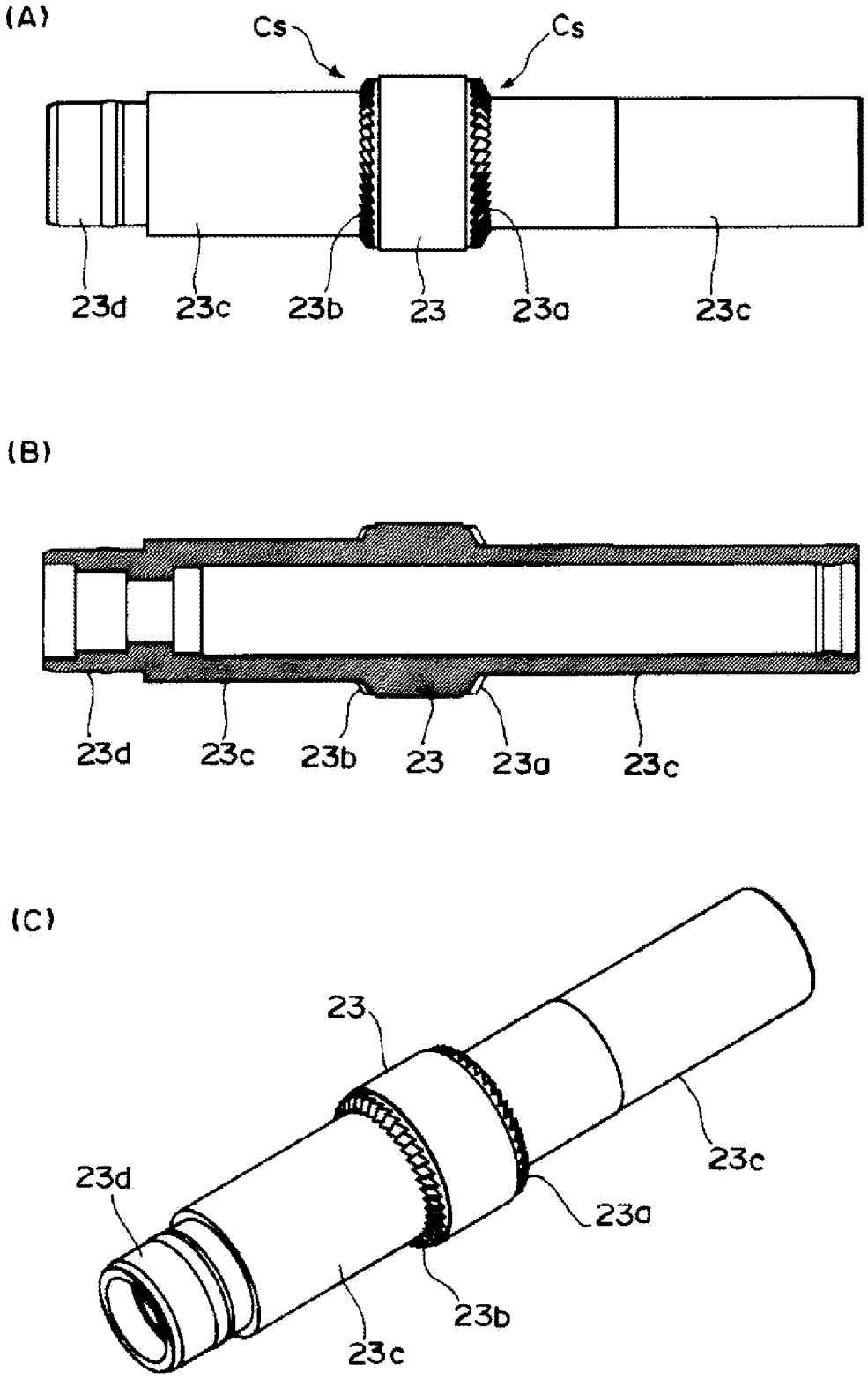
FIGS. 25(A) to 25(C) include outline views and a sectional view of a single configuration of a rotatable cam illustrated in FIGS. 24(A) and 24(B).
Figure 26:
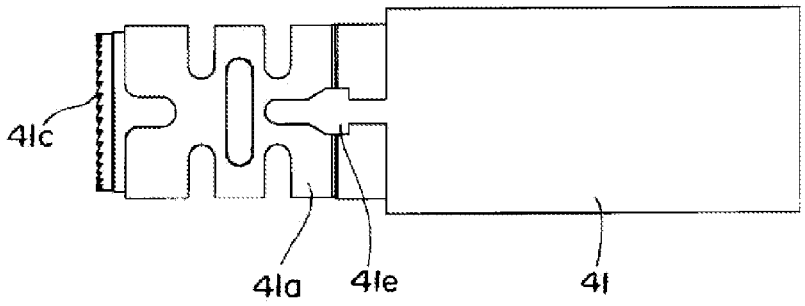
FIGS. 26(A) to 26(C) include an outline view and sectional views of a single configuration of a first fixed cam formation member illustrated in FIGS. 24(A) and 24(B).
Figure 26:
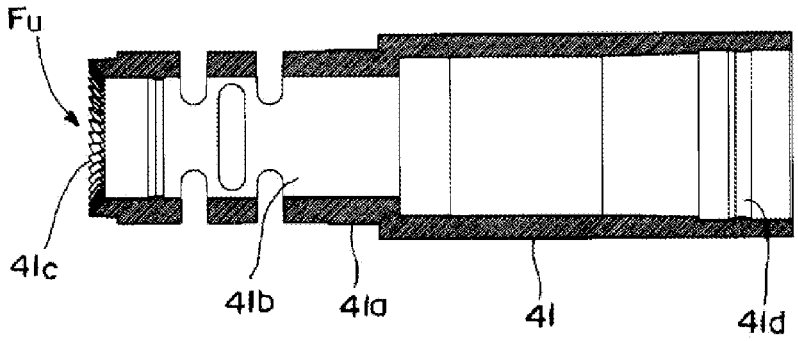
Figure 26:
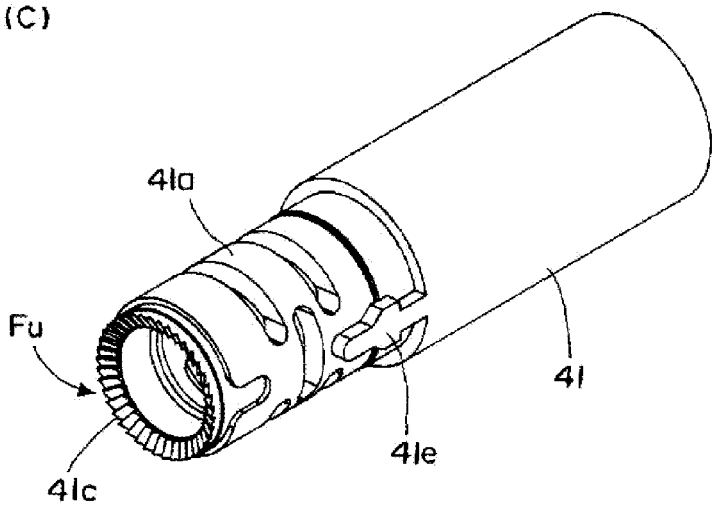
Figure 27:
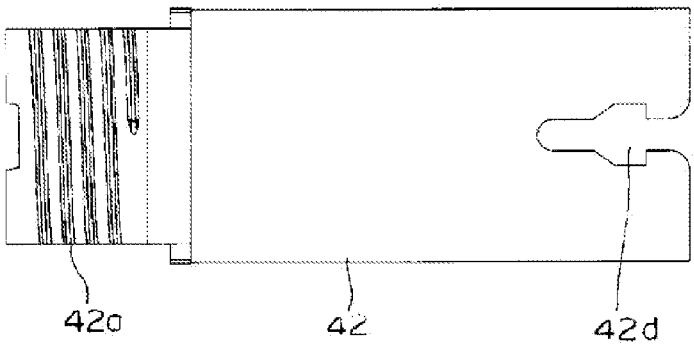
FIGS. 27(A) to 27(C) include outline views and a sectional view of a single configuration of a second fixed cam formation member illustrated in FIGS. 24(A) and 24(B).
Figure 27:
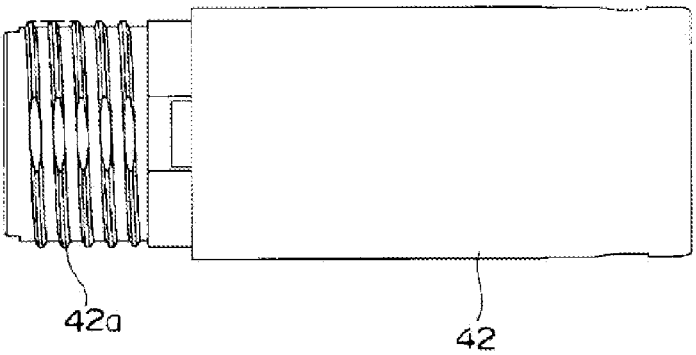
Figure 27:
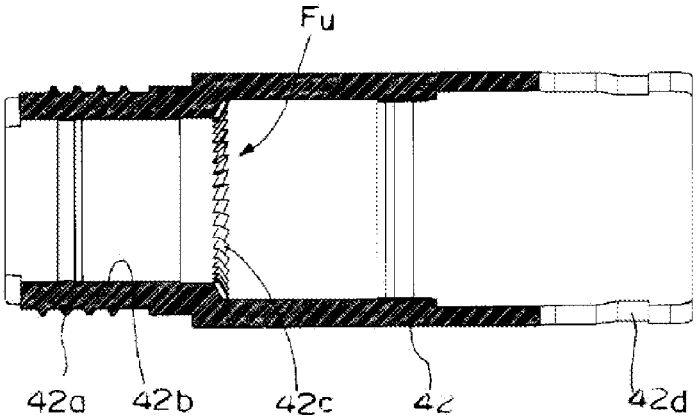

In the third embodiment, the elastic members 22*b* in the holder member 22 have convex abutment portions 22*m* on the outer surfaces thereof, as illustrated in FIGS. 18 to 22. As illustrated in FIG. 23, when the rotational drive mechanism 21 is attached to the body cylinder 1, the abutment portions 22*m* come into partial contact with the inner periphery of the body cylinder 1 to prevent the pair of the elastic members 22*b* from being expanded outward from the axis of the holder member 22. This prevents that the rotatable cam 23 is pressed and moved excessively forward by the cushion member 24. As a result, it is possible to suppress variations in projecting dimensions from the base member 3 of the slider 9, the pipe end 10, and the like which project from the base member 3.

Figure 19:
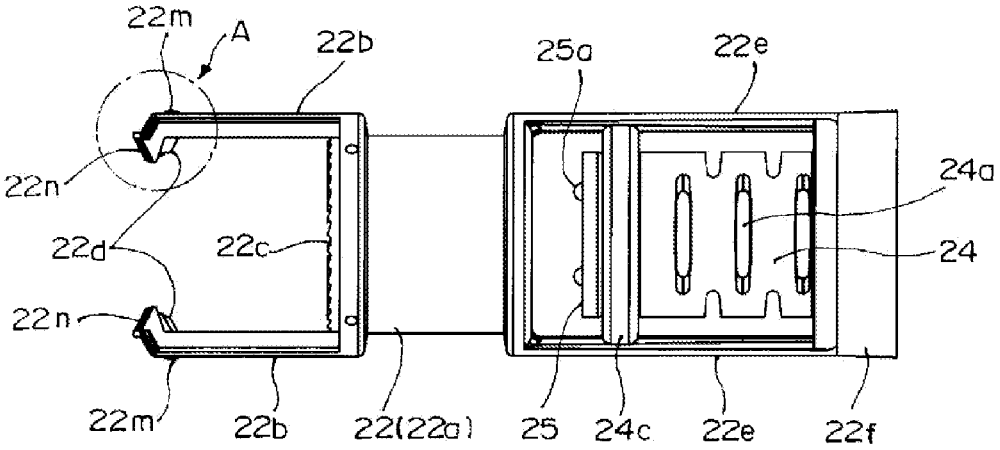
FIG. 19 is a front view of the holder member illustrated in FIG. 18.
Figure 20:
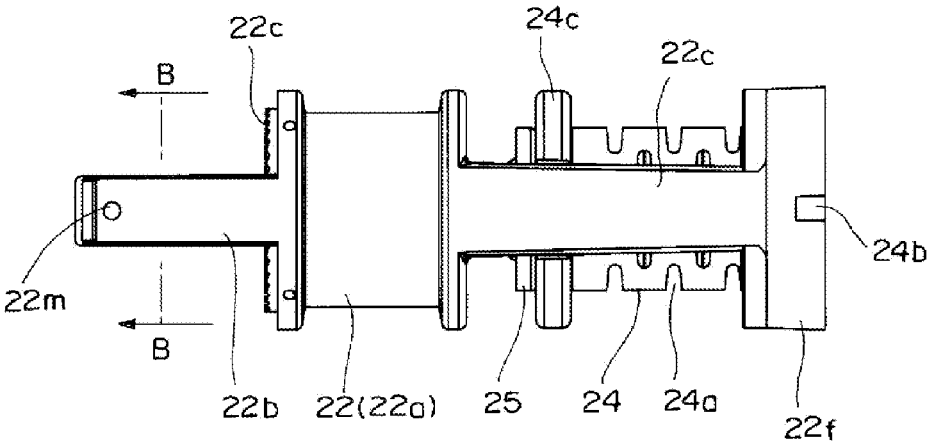
FIG. 20 is a side view of the holder member axially rotated 90 degree from the state illustrated in FIG. 19.

In this case, the elastic members 22 desirably have at the tip portions thereof tapered faces 22*n* toward the axis as illustrated in FIGS. 18 and 19.

Specifically, as illustrated in FIG. 23, a circular projecting portion 1*b* formed integrally with the body cylinder 1 comes into abutment with the tapered faces 22*n* to allow a biasing force to exert on the pair of elastic members 22*b* to expand outward from the axis.

As described above, the pair of elastic members 22*b* in the body cylinder 1 is subjected to the action of the abutment portions 22*m* to suppress outward expansion and is subjected to the biasing force of the tapered faces 22*n* to expand outward from the axis.

Therefore, the pair of elastic members 22*b* is attached to the body cylinder 1 with a constant spacing therebetween under the two actions, thereby to realize correct positioning of the rotatable cam 23 in the axis direction. This contributes to reduction in variations of projecting dimensions of the slider 9 and the pipe end 10 from the base member 3.

In the example of FIG. 23, the abutment portions 22*m* and the tapered faces 22*n* of the holder member 22 are both configured to be in partial contact with the body cylinder 1. However, even when the abutment portions 22*m* and the tapered faces 22*n* are both configured to be in partial contact with any other member disposed between the body cylinder 1 and the holder member 22, the same advantageous effects can be produced.

In the first to third embodiments described above, by using the rotatable cam 23 with the cam face of the lower cam 23*b* formed on the conical inclined surface Cs as illustrated in FIG. 9 and the rotatable cam 23 with the cam faces of the upper cam 23*a* and the lower cam 23*b* formed on the conical inclined surfaces Cs as illustrated in FIG. 16, for example, it is possible to realize an ideal meshing state in which the axis of the rotatable cam 23 aligns with the axis of the holder member 22.

In this case, although not illustrated, the rotatable cam 23 may be configured such that only the cam face of the upper cam 23*a* is formed on the conical inclined surface Cs, and the first fixed cam 22*c* of the holder member 22 may be formed on the funnel-shaped inclined surface Fu as illustrated in FIG. 13, for example. This configuration also ensures smooth rotational drive operation of the rotational drive mechanism 21.

The foregoing descriptions of the first to third embodiments are given mainly as to the relationship between the holder member 22 and the rotatable cam 23 constituting the rotational drive mechanism 21. However, the mechanical pencil according to the present invention does not necessarily include the holder member 22 with such a specific structure as described above.

Configurations of the rotational drive mechanism described below also make it possible to provide a mechanical pencil ensuring smooth rotational drive operation of the rotatable cam 23.

FIGS. 24(A) to 27(C) illustrate a fourth embodiment of the mechanical pencil according to the present invention.

FIGS. 24(A) and 24(B) illustrates the entire configuration of the mechanical pencil in which reference sign 1 denotes a body cylinder constituting the outer part of the mechanical pencil, and reference sign 3 denotes a base portion attached to the tip portion of the body cylinder 1. The cylindrical lead case 4 is accommodated in the center of the body cylinder 1 so as to be coaxial with the body cylinder 1. The chuck 6 is connected to the tip portion of the lead case 4.

The chuck 6 has a through hole along the axis and a tip portion divided into three pieces. The divided tip pieces are loosely fitted in the ring-shaped clamp 7. The ring-shaped clamp 7 is attached to the inner surface of the tip portion of the cylindrical rotatable cam 23 arranged to surround the chuck 6.

The mechanical pencil includes a pipe end 11 projecting from the base portion 3 to guide the writing lead. The base portion of the pipe end 11 is fitted and attached by a pipe holder member to the inner surface of the tip portion of the slider 9 positioned in the base portion 3. The slider 9 has a cylindrical portion formed in a continuous stepwise manner such that its base portion (rear end) is larger in diameter. The inner surface of the base portion of the slider 9 is fitted to the peripheral surface of the tip portion of the rotatable cam 23. The rubber holder chuck 12 with a through hole at its axis is accommodated in the inner periphery of the slider 9.

According to the foregoing configuration, a linear lead inserting hole is formed in such a manner as to reach the pipe end 11 via the through hole formed in the chuck 6 by the lead case 4 and via the through hole formed along the axis of the holder chuck 12. The writing lead (refill lead) is inserted into this linear lead inserting hole. Further, a coil-like chuck spring 13 is provided between the rotatable cam 23 and the chuck 6.

One end (rear end) of the chuck spring 13 is accommodated in abutment with the end surface of the lead case 4, and the other end (front end) of the chuck spring 13 is accommodated in abutment with the circular end surface formed in the rotatable cam 23. Therefore, the chuck 6 in the rotatable cam 23 is biased to be moved backward by the action of the chuck spring 13.

The rotatable cam 23 is accommodated so as to be rotatable and axially movable in a first fixed cam formation member 41 and a second fixed cam formation member 42 that are each formed in a cylindrical shape and axially connected. Detailed configurations of the rotatable cam 23, the first fixed cam formation member 41, and the second fixed cam formation member 42 will be described later with reference to the drawings illustrating their respective single configurations.

As illustrated in FIGS. 24(A) and 24(B), a cylindrical stopper 43 is fitted into the first fixed cam formation member 41 and attached to the inner surface of the read end of the cylindrical first fixed cam formation member 41. A coil cushion spring 44 is attached between the front end portion of the stopper 43 and a cylindrical torque canceller 25 movable in the axial direction.

The cushion spring 44 acts to bias the torque canceller 25 forward, and the torque canceller 25 subjected to the biasing force pushes the rotatable cam 23 forward.

Therefore, in the fourth embodiment illustrated in FIGS. 24(A) and 24(B), the rotational drive mechanism 21 for writing lead is formed into a unit from the rotatable cam 23, the first fixed cam formation member 41, the second fixed cam formation member 42, the stopper 43, the cushion spring 44, and the torque canceller 25.

A cylindrical knock bar 46 is accommodated in the inner surface of the read end of the body cylinder 1 so as to be axially slidable. The knock bar 46 is biased toward the back of the body cylinder 1 by an axial spring 47 arranged between the knock bar 46 and the stopper 43.

At the rear end of the body cylinder 1, the clip support body 33 with the integrally formed clip 33*a* is fitted and attached into the body cylinder 1. A circular step portion 33*b* formed in the clip support body 33 constitutes a stopper mechanism to prevent the knock bar 46 from coming off the rear end of the body cylinder 1.

The rear end portion of the knock bar 46 is formed in a circular shape and is projected slightly more backward than the rear end portion of the clip support body 33. The eraser 34 is attached to the inner surface of the rear end portion of the knock bar 46. The knock cover 35 made of a transparent or translucent resin material, constituting the knock portion and covering the eraser 34, is detachably attached to the knock bar 46 so as to cover the outer periphery of the rear end portion of the knock bar 46.

A writing lead feeding hole 46*a* is formed in the knock bar 46 at the attachment position of the eraser 34.

In the foregoing configuration of the mechanical pencil, when a knock operation is performed to push down the knock cover 35 by a thumb or the like, for example, the knock cover 35 acts to push the lead case 4 forward via the knock bar 46. Accordingly, the chuck 6 is moved forward to feed the writing lead from the pipe end 11. Then, when the knock operation is stopped, the knock bar 46 is moved backward by the action of the chuck spring 13 and locked at the step portion 33*b* on the inner surface of the clip support body 33.

FIGS. 25(A) to 25(C) illustrate in an enlarge manner a single configuration of the rotatable cam 23 used in the mechanical pencil illustrated in FIGS. 24(A) and 24(B). FIG. 25(A) is a front view, FIG. 25(B) is a sectional view, and FIG. 25(C) is a perspective view. The rotatable cam 23 is almost the same in configuration as the rotatable cam used in the second embodiment illustrated in FIG. 16 described above.

That is, the rotatable cam 23 illustrated in FIGS. 25(A) to 25(C) has an axially middle portion larger in diameter as a large-diameter portion, and upper and lower conical inclined surfaces Cs formed from the large-diameter portion toward small-diameter portions serving as the rotation axis 23*c* on the both sides.

The upper cam 23*a* and the lower cam 23*b* are formed on the upper and lower inclined surfaces Cs. The upper cam 23*a* and the lower cam 23*b* have a large number of sawtooth cams continued in a circle on the inclined surfaces Cs.

The tip portion of the rotation axis 23*c* continued from the lower cam 23*b* constitutes a small-diameter fit portion 23*d*. The slider 9 is attached to the fit portion 23*d* as illustrated in FIGS. 24(A) and 24(B).

FIGS. 26(A) to 26(C) illustrate a single configuration of the first fixed cam formation member 41. FIG. 26(A) is a front view, FIG. 26(B) is a sectional view, and FIG. 26(C) is a perspective view. The first fixed cam formation member 41 has an axially front half portion slightly reduced in outer diameter as a small-diameter portion 41*a* and formed in a cylindrical shape.

The inner surface of the small-diameter portion 41*a* constitutes a bearing portion 41*b* for the rotatable cam 23. A first fixed cam 41*c* is formed at the tip portion of the small-diameter portion 41*a*.

The first fixed cam 41*c* has a large number of sawtooth cams continued in a circle. The cam face of the first fixed cam 41*c* is formed on the funnel-shaped inclined surface Fu.

The first fixed cam formation member 41 has an undercut portion 41*d* formed at the end opposite to the end with the first fixed cam 41*c*. The undercut portion 41*d* is used for attachment of a stopper 43 as illustrated in FIGS. 24(A) and 24(B).

In addition, the first fixed cam formation member 41 has a connection convex portion 41*e* extended from the axially central portion toward the small-diameter portion 41*a*. The connection convex portion 41*e* is joined and connected to a connection concave portion in a second fixed cam formation member 42 described later.

FIGS. 27(A) to 27(C) illustrate a single configuration of the second fixed cam formation member 42. FIG. 27(A) is a front view, FIG. 27(B) is a top view, and FIG. 27(C) is a sectional view. The second fixed cam formation member 42 is formed in a cylindrical shape and has a front end portion slightly reduced in outer diameter to form a male thread 42*a*. The base member 3 is screwed and fastened by the male thread 42*a* as illustrated in FIGS. 24(A) and 24(B). The inner periphery of the second fixed cam formation member 42 with the male threads 42*a* serves as a bearing portion 42*b* for the rotatable cam 23.

A second fixed cam 42*c* is formed from the bearing portion 42*b* toward a portion with larger in inner diameter. The second fixed cam 42*c* has a large number of sawtooth cams continued in a circle. The cam face of the second fixed cam 42*c* is formed on the funnel-shaped inclined surface Fu.

The second fixed cam formation member 42 has at the rear end portion a connection concave portion 42*d* formed by cutting partially the cylindrical portion. The connection concave portion 42*d* is fitted to the connection convex portion 41*d* of the first fixed cam formation member 41 to connect the first and second fixed cam formation members 41 and 42 in the axial direction.

According to the rotational drive mechanism 21 for writing lead as described above, the writing lead is gradually rotationally driven by cushioning action in one direction as in the embodiment described above. In addition, according to the rotational drive mechanism 21 in this embodiment, the cam face of the upper cam 23*a* and the cam face of the lower cam 23*b* in the rotatable cam 23 are formed on the conical inclined surfaces Cs.

Further, the cam face of the first fixed cam 41*c* and the cam face of the second fixed cam 42*c* axially meshing with the upper and lower cam faces of the rotatable cam 23 are formed on the funnel-shaped inclined surfaces Fu.

Therefore, it is possible to realize an ideal meshing state of the rotatable cam 23 in which the axis of the rotatable cam 23 aligns with the axes of the first fixed cam formation member 41 and the second fixed cam formation member 42 in each of the axial directions. This ensures more smooth rotational drive operation of the rotational drive mechanism 21.

Figure 28:
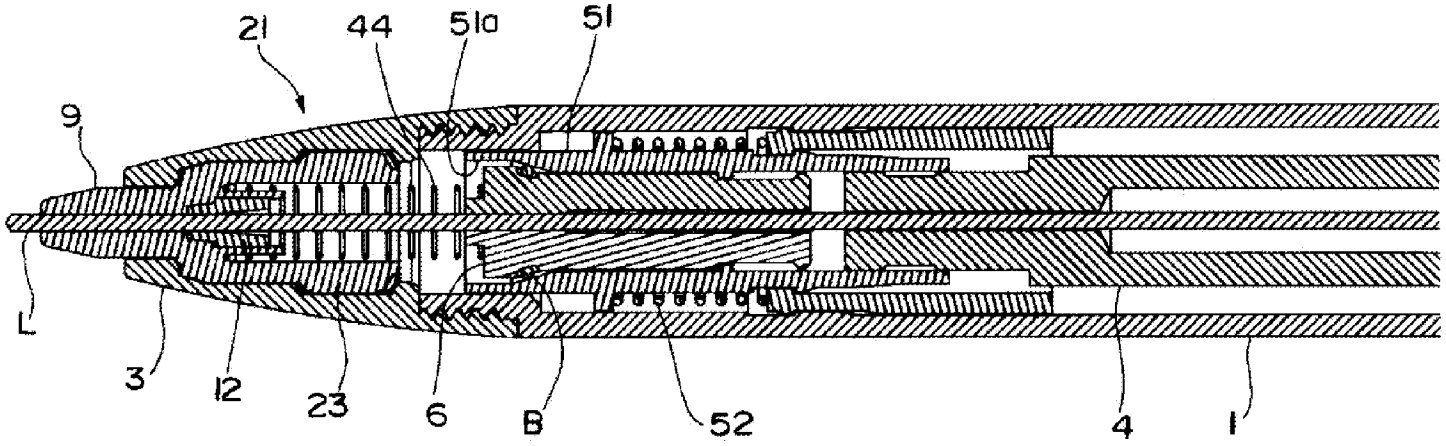
FIG. 28 is a sectional view of a mechanical pencil according to a fifth embodiment.
Figure 29:
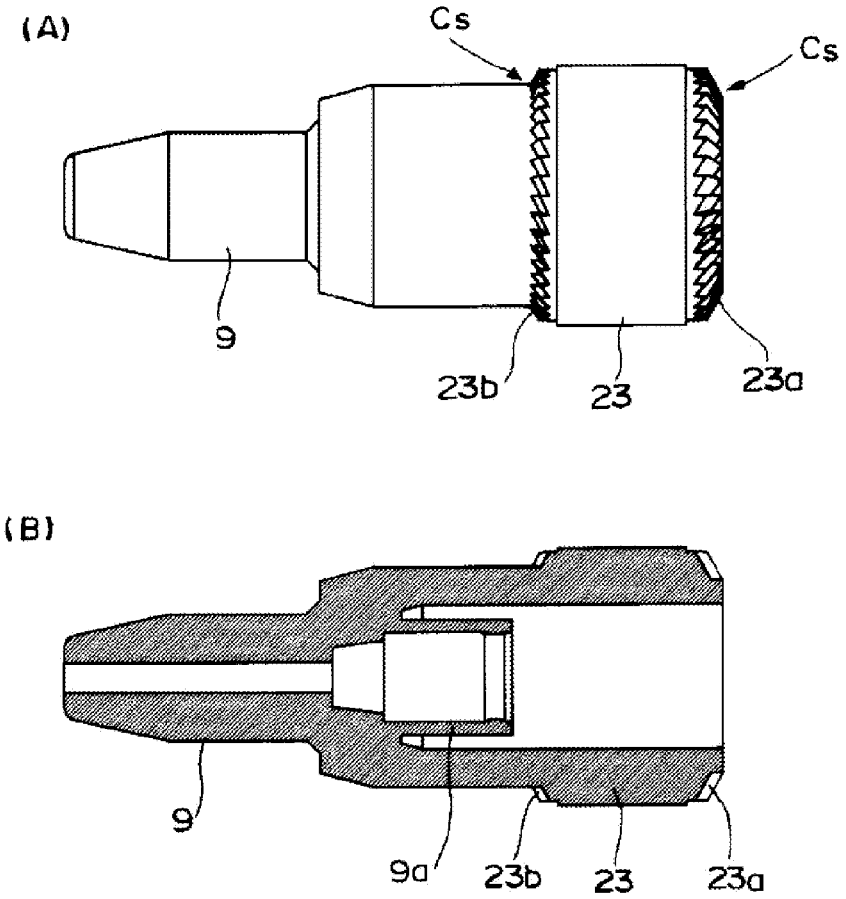
FIGS. 29(A) and 29(B) include an outline view and a sectional view of a single configuration of a rotatable cam illustrated in FIG. 28.
Figure 30:
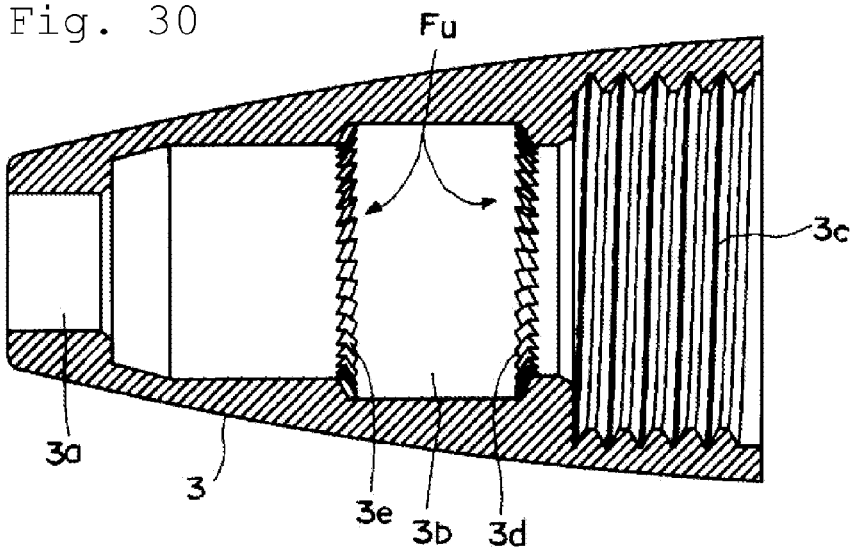
FIG. 30 includes an outline view and a sectional view of a single configuration of a first fixed cam formation member illustrated in FIG. 28.

FIGS. 28 to 30 illustrate a fifth embodiment of the mechanical pencil according to the present invention. FIG. 28 is a sectional view of the entire configuration of the mechanical pencil, in which components performing the same functions as those described above are given the same reference signs as those described above. Therefore, detailed descriptions thereof will be omitted here.

In the fifth embodiment, the first fixed cam and the second fixed cam constituting the rotational drive mechanism 21 are formed in the base member 3 at the front end portion of the body cylinder 1. The rotatable cam 23 including the upper and lower cam faces is formed integrally with the slider 9 positioned in the base member 3.

As illustrated in FIG. 28, the mechanical pencil includes a ball chuck storing a plurality of balls B between the chuck 6 and a chuck holder 51 arranged on the outside of the chuck 6.

The chuck holder 51 is connected to the front end portion of the lead case 4 so as to be movable in the axial direction. The chuck holder 51 is biased forward by a spring 52. The chuck holder 51 has a tapered face 51*a* widened forward on the inner wall surface of the tip portion. The balls B can roll along the tapered face 51*a*.

In the ball chuck, when writing pressure is applied to the writing lead, the chuck 6 comes into abutment with the tapered face of the chuck holder 51 together with the balls B, whereby the writing lead is held by the chuck 6. However, when a force of pulling the writing lead forward is applied, the chuck 6 and the balls B move forward along the tapered face of the chuck holder 51. Thus, no gripping force of the chuck 6 is applied to the writing lead.

Therefore, when the knock operation is performed to move the lead case 4 forward, the chuck holder 51 and the chuck 6 also move forward to feed a writing lead L from the slider 9. When the knock operation is stopped, the chuck 6 is moved backward by the action of the cushion spring 44, but the writing lead L is held by the holder chuck 12 and thus the backward movement of the writing lead L is blocked. Therefore, by performing repeatedly the knock operation, the writing lead L is gradually fed from the slider 9.

As described above, the rotational drive mechanism 21 for writing lead according to the embodiment is composed of the base member 3 and the slider 9.

FIGS. 29(A) and 29(B) illustrate a single configuration of the slider 9. FIG. 29(A) is a front view, and FIG. 29(B) is a sectional view. The slider 9 has the rotatable cam 23 integrally formed as described above.

Specifically, the rear end portion of the slider 9 is made as a large-diameter portion, and the rotatable cam 23 is formed on the large-diameter portion. The both axial end surfaces of the large-diameter portion are conically shaped to form the upper and lower inclined surfaces Cs. The upper cam 23*a* and the lower cam 23*b* are formed on the upper and lower inclined surfaces Cs. The upper cam 23*a* and the lower cam 23*b* have a large number of sawtooth cams continued in a circle on the inclined surfaces Cs.

The slider 9 has a cylindrical portion 9*a* formed inside so as to be coaxial with the slider 9. There is a receiving portion for the cushion spring 44 formed between the slider 9 and the cylindrical portion 9*a*. The holder chuck 12 is accommodated in the cylindrical portion 9*a* as illustrated in FIG. 28.

FIG. 30 is a sectional view of a single configuration of the base member 3. The base member 3 is axially increased stepwise in inner diameter. The base member 3 accommodates the slider 9 with the rotatable cam 23 integrally formed illustrated in FIGS. 29(A) and 29(B).

Specifically, the tip portion of the slider 9 is accommodated in the opening 3*a* at the tip portion of the base member 3. The rotatable cam 23 is accommodated in a central space 3*b* of the base member 3 so as to be rotatable and axially movable. A female thread 3*c* is cut in the inner surface of the rear end portion of the base member 3 for screwing into the tip portion of the body cylinder 1.

The central space 3*b* of the base member 3 has the funnel-shaped inclined surfaces Fu at corners on the both axial sides. The funnel-shaped inclined surfaces Fu have a large number of sawtooth cams continued in a circle to constitute a first fixed cam 3*d* and a second fixed cam 3*e*. That is, in the embodiment, the funnel-shaped inclined surfaces Fu in the base member 3 also serve as a first fixed formation member and a second fixed cam formation member.

According to the mechanical pencil of the fifth embodiment, the slider 9 and the rotatable cam 23 formed integrally with the slider 9 are moved backward under writing pressure resulting from a writing action. Upon release of the writing pressure, a cushioning action is performed to move the slider 9 and the rotatable cam 23 forward by the cushion spring 44.

By this cushioning action, the slider 9 is rotationally driven in the manner described above. The writing lead L is also rotationally driven via the holder chuck 12 attached to the slider 9.

In the fifth embodiment, as in the fourth embodiment, the cam face of the upper cam 23*a* and the cam face of the lower cam 23*b* in the rotatable cam 23 are formed on the conical inclined surfaces Cs.

The cam face of the first fixed cam 3*d* and the cam face of the second fixed cam 3*e* axially meshing with the upper and lower cam faces of the rotatable cam 23 are formed on the funnel-shaped inclined surfaces Fu.

Therefore, it is possible to realize an ideal meshing state in which the axis of the rotatable cam 23 integrated with the slider 9 aligns with the axis of the base member 3 serving as the first fixed cam formation member and the second fixed cam formation member, in each of the axial directions. This ensures more smooth rotational drive operation of the rotational drive mechanism 21.

Figure 31:
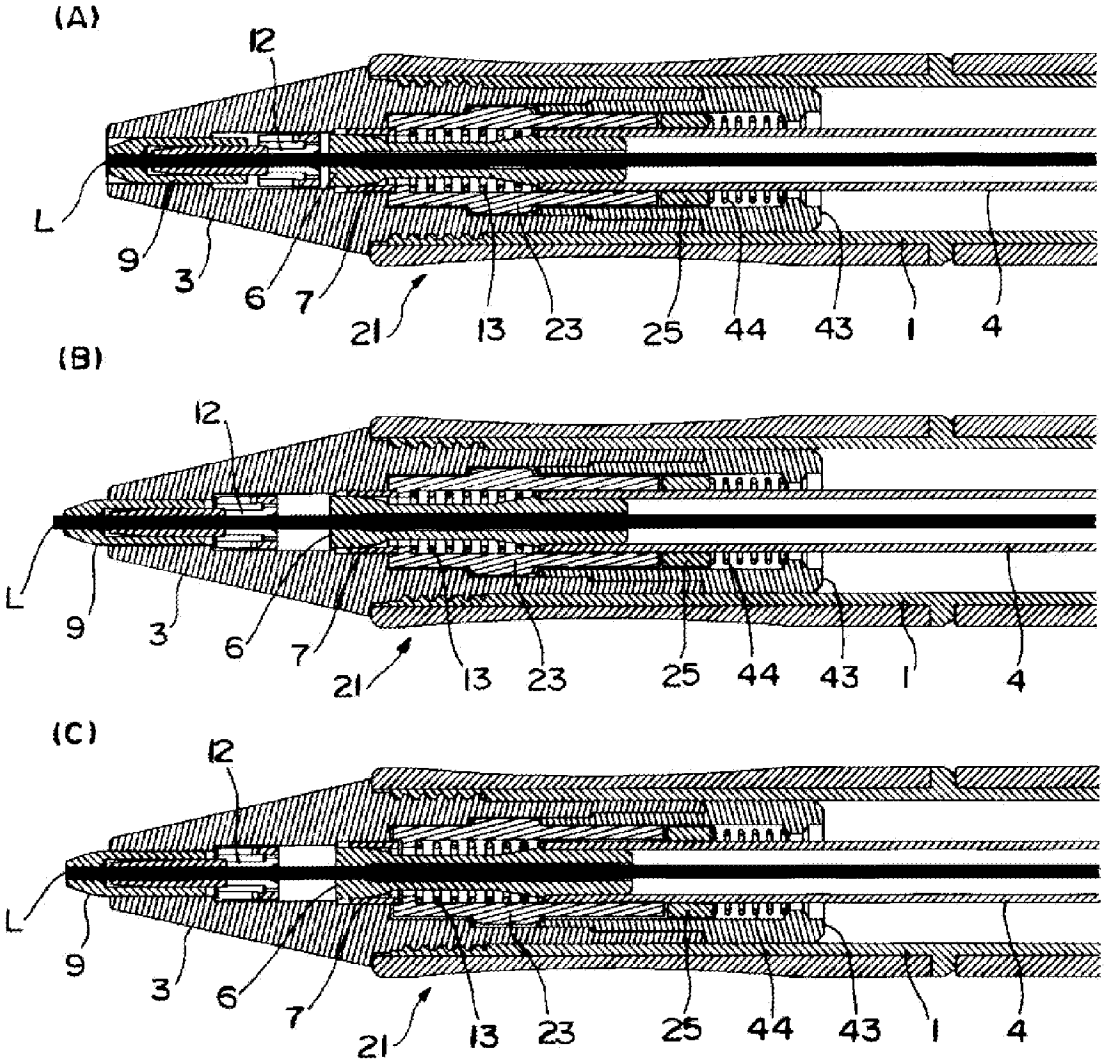
FIGS. 31(A) to 31(C) include sectional views of a mechanical pencil in a sixth embodiment.
Figure 32:
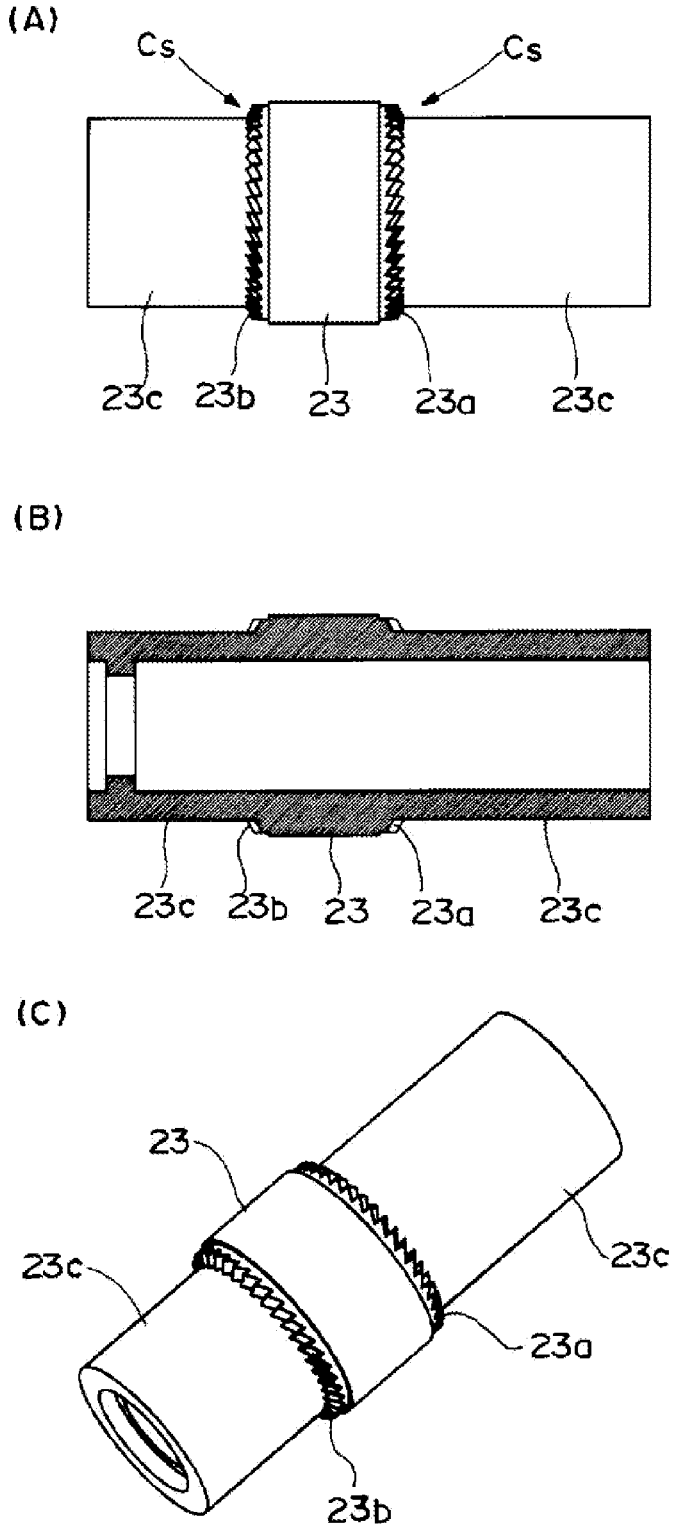
FIGS. 32(A) to 32(C) include an outline view and sectional views of a single configuration of a rotatable cam illustrated in FIGS. 31(A) to 31(C).

FIGS. 31(A) to 34(C) illustrate a sixth embodiment of the mechanical pencil according to the present invention. FIGS. 31(A) to 31(C) are sectional views of the front half portion of the mechanical pencil, in which components performing the same functions as those described above are given the same reference signs as those described above. Therefore, overlapping descriptions will be omitted here.

In the sixth embodiment, the first fixed cam constituting the rotational drive mechanism 21 is formed at a stopper attached to the rear end portion of the base member, the second fixed cam is formed in the base member, and the rotatable cam with the upper and lower cam faces are accommodated in the base member.

In the sixth embodiment, the slider 9 serving as a tip guide member for insertion of the writing lead L is slidably arranged together with the holder chuck 12 in the base member 3 as illustrated in FIGS. 31(A) to 31(C). The slider 9 is configured to have the tip portion capable of appearing and disappearing from the base member 3.

The relationship between the appearing and disappearing action of the slider 9 from the base member 3 and the rotational drive mechanism 21 for writing lead will be described later with reference to FIGS. 31(A) to 31(C).

FIGS. 32(A) to 32(C) illustrate in enlarged views a single configuration of the rotatable cam 23 used in the mechanical pencil illustrated in FIGS. 31(A) to 31(C). FIG. 32(A) is a front view, FIG. 32(B) is a sectional view, and FIG. 32(C) is a perspective view. The rotatable cam 23 is configured in the same manner as that of the rotatable cam illustrated in FIGS. 16 and 25 described above. Therefore, components performing the same functions as those described above are given the same reference signs as those described above.

The rotatable cam 23 is connected to a writing lead LI via the clamp 7 and the chuck 6 as illustrated in FIGS. 31(A) to 31(C). The rotatable cam 23 is configured to transfer the rotational drive force of the rotational drive mechanism 21 to the writing lead LI.

Figure 33:
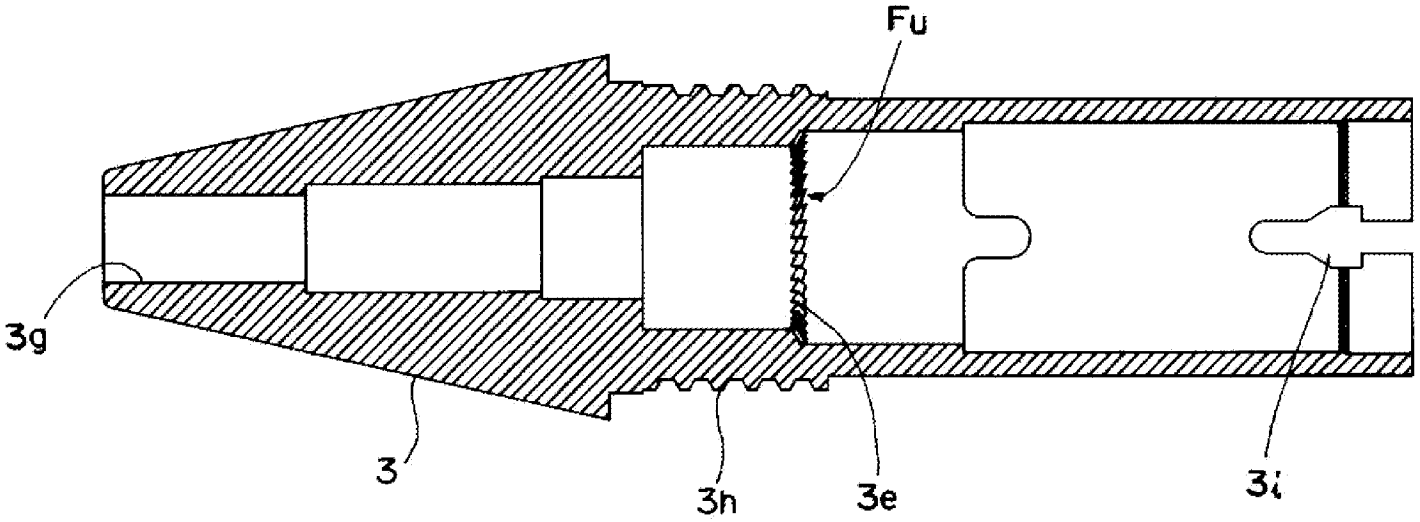
FIG. 33 is a sectional view of a single configuration of a base member illustrated in FIGS. 31(A) to 31(C).
Figure 34:
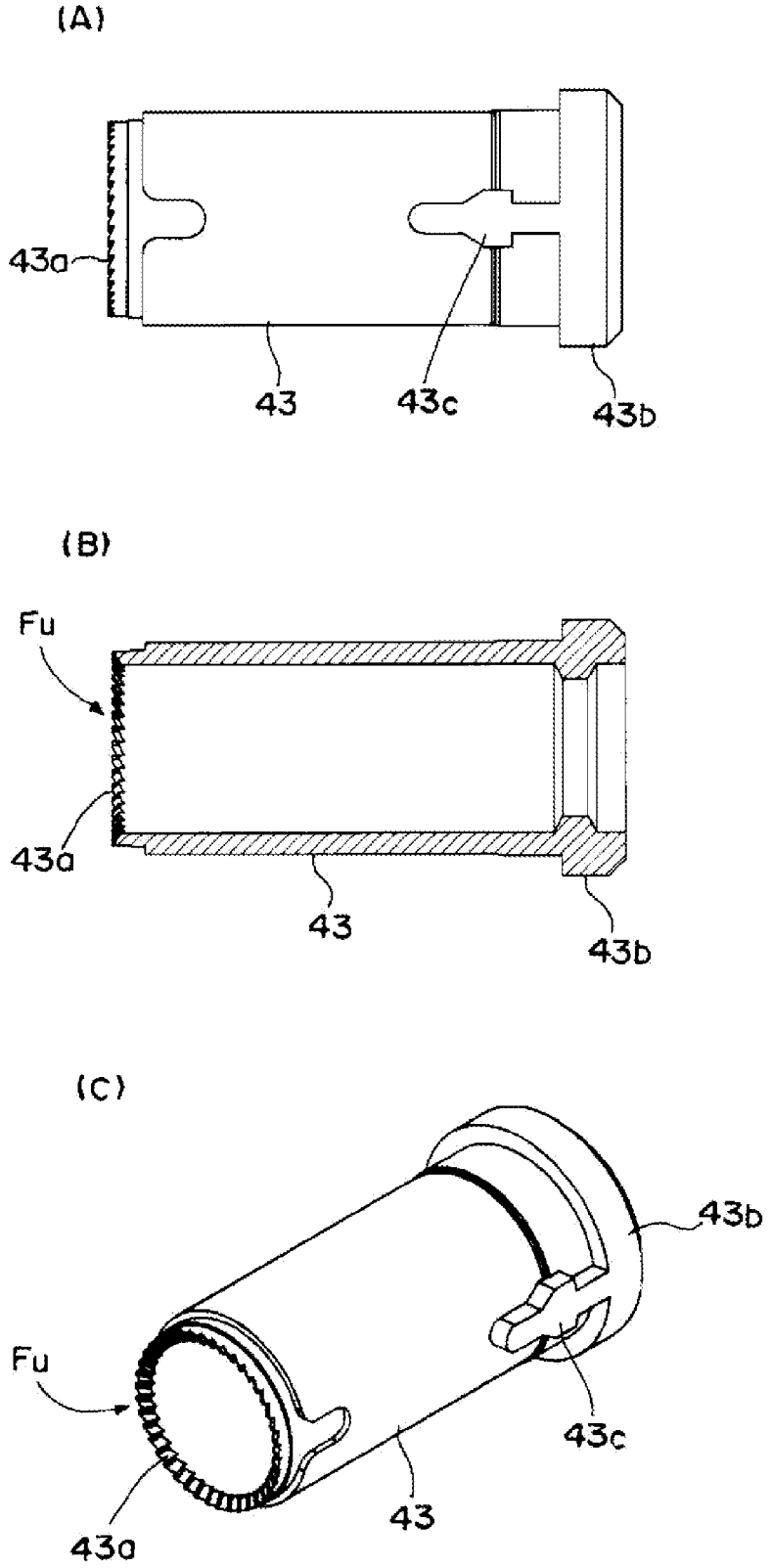
FIGS. 34(A) to 34(C) include sectional views of a single configuration of a stopper illustrated in FIGS. 31(A) to 31(C).

FIG. 33 is an enlarged sectional view of a single configuration of the base member 3. The base member 3 has a front end portion formed in a conical shape and has an opening 3*g* supporting the slider 9 so as to be capable of appearing and disappearing. The base member 3 also has a male thread 3*h* for screwing into the front end portion of the body cylinder 1 at the outer periphery of the axially central portion, and has at the rear end portion a connection concave portion 3*i* formed by cutting partially the cylindrical portion. The connection concave portion 3*i* is used to connect a stopper 43 described later to the rear end portion of the base member 3.

The base member 3 has an axial hole increased in inner diameter stepwise from the opening 3*g* at the front end portion to the rear end portion. The portion increased in inner diameter at almost the axially central portion of the base member 3 is used to form the second fixed cam 3*e*.

The second fixed cam 3*e* has a large number of sawtooth cams continued in a circle. The cam face of the second fixed cam 3*e* is formed on the funnel-shaped inclined surface Fu.

FIGS. 34(A) to 34(C) illustrate in enlarged views a single configuration of the stopper 43 attached to the rear end portion of the base member 3. FIG. 34(A) is a front view, FIG. 34(B) is a sectional view, and FIG. 34(C) is a perspective view.

The stopper 43 is formed in an almost cylindrical shape and has a first fixed cam 43*a* formed at the front end portion. The first fixed cam 43*a* has a large number of sawtooth cams continued in a circle. The cam face of the first fixed cam 43*a* is formed on the funnel-shaped inclined surface Fu.

The stopper 43 also has a large-diameter portion 43*b* formed at the axially rear end portion and a connection convex portion 43*c* continued forward from the large-diameter portion 43*b*. Therefore, by inserting the stopper 43 into the rear end portion of the base member 3 illustrated in FIG. 33, the connection convex portion 43*c* formed in the stopper 43 is connected to the connection concave portion 3*i* formed in the base member 3, whereby the stopper 43 is attached to the base member 3.

To attach the stopper 43 to the base member 3, the rotatable cam 23, the torque canceller 25, the cushion spring 44 and the like illustrated in FIGS. 31(A) to 31(C) are axially inserted and assembled in sequence.

In the mechanical pencil of the sixth embodiment, the rotatable cam 23 constituting the rotational drive mechanism 21 is rotated by the cushioning action and the writing lead L is rotationally driven, which is the same as in the foregoing embodiments.

In addition, as in the fourth and fifth embodiments, the cam face of the upper cam 23*a* and the cam face of the lower cam 23*b* in the rotatable cam 23 are formed on the conical inclined surfaces Cs. The cam face of the first fixed cam 43*a* and the cam face of the second fixed cam 3*e* axially meshing with the upper and lower cam faces of the rotatable cam 23 are formed on the funnel-shaped inclined surfaces Fu.

Therefore, it is possible to realize an ideal meshing state in which the axis of the rotatable cam 23 aligns with the axis of the stopper 43 and the axis of the base member 3. This ensures more smooth rotational drive operation of the rotational drive mechanism 21.

Meanwhile, in the sixth embodiment illustrated in FIGS. 31(A) to 34(C), the slider 9 is slidably arranged together with the holder chuck 12 in the base member 3 as described above. The slider 9 is configured to be capable of appearing and disappearing from the base member 3.

FIG. 31(A) illustrates the state in which the tip portion of the slider 9 is pressed under a predetermined pressure to move both the slider 9 and the writing lead L backward.

In the state of FIG. 31(A), when the knock cover not illustrated at the rear end portion of the body cylinder 1 is knocked, the lead case 4 is moved forward, and the holder chuck 12, the slider 9, and the writing lead L are moved forward accordingly.

As a result, the slider 9 is projected from the base member 3, and the writing lead L is projected from the tip portion of the slider 9 as illustrated in FIG. 31(B). At that time, the writing lead L is rotationally driven by the rotational drive mechanism 21 in one direction.

When writing is continued in the state illustrated in FIG. 31(B), the writing lead L is subjected to rotational drive operation of the rotational drive mechanism 21 by the cushioning action described above.

Then, when the writing lead L becomes worn and reaches the state illustrated in FIG. 31(C) in which the tip portion of the writing lead L aligns with the tip portion of the slider 9, cushion pressure (pressing pressure) is applied to the tip portion of the slider 9, and the writing lead L is rotationally fed from the tip portion of the slider 9 by the biasing force of the cushion spring 44. Therefore, the mechanical pencil illustrated in FIGS. 31(A) to 31(C) makes it possible to continue writing without interruption.

In the fourth to sixth embodiments described above, the cam faces of the first fixed cam and the second fixed cam are both formed on the funnel-shaped inclined surfaces Fu, and the upper and lower cam faces of the rotatable cam are both formed on the conical inclined surfaces Cs.

According to this configuration, as described above, it is possible to realize an ideal meshing state in which the rotatable cam aligns with the axes of the first and second fixed cams in both moving directions.

However, even when the mechanical pencil is configured such that one of the fixed cams is formed on a funnel-shaped inclined surface and the cam face of the rotatable cam meshing with the fixed cam is formed on a conical inclined surface, it is also possible to realize an ideal meshing state in one of the axial directions. Therefore, the latter configuration can also be favorably applied to this kind of mechanical pencil.

EXPLANATION OF REFERENCE SIGNS

1 Body cylinder
3 Base member
3*d* First fixed cam
3*e* Second fixed cam
4 Lead case
6 Chuck
7 Clamp
9 Slider
10 Pipe end
12 Holder chuck
13 Chuck spring
21 Rotational drive mechanism
22 Holder member
22*a* Cylindrical portion
22*b* Elastic member
22*c* First fixed cam
22*d* Second fixed cam
22*e* Columnar body
22*f* Ring member
22*g* Inclined surface
22*h* Cam face
22*i* Cam face
22*j* Ridge line
22*m* Abutment portion
22*n* Tapered face
23 Rotatable cam
23*a* Upper cam
23*b* Lower cam
23*c* Rotation axis
24 Cushion member
25 Slip member (torque canceller)
31 Eraser cradle
31*a* Undercut portion
31*b* First spring body
31*c* Second spring body
33 Clip support body
33*a* Clip
34 Eraser
35 Knock cover
41 First fixed cam formation member
41*c* First fixed cam
42 Second fixed cam formation member
42*c* Second fixed cam
43 Stopper
43*a* First fixed cam
44 Cushion spring
46 Knock bar
47 Axis spring
51 Chuck holder
52 Spring
B Ball
Cs Conical inclined surface
Fu Funnel-shaped inclined surface
L Writing lead

The invention claimed is:

1. A mechanical pencil, comprising:
a rotational drive mechanism including
a rotatable cam,
a first fixed cam, and
a second fixed cam,
wherein the rotatable cam is rotationally driven according to writing pressure applied to a writing lead, such that rotational motion of the rotatable cam is transferred to the writing lead,
wherein the rotatable cam has upper and lower cam faces orthogonal to an axial direction,
wherein the first fixed cam and the second fixed cam face each other with the upper and lower cam faces of the rotatable cam therebetween,
wherein at least one of the first fixed cam and the second fixed cam has a cam face formed on a funnel-shaped inclined surface, and
wherein one of said upper and lower cam faces of the rotatable cam meshing with the cam face on the funnel-shaped inclined surface is formed on a conical inclined surface.

2. The mechanical pencil according to claim 1, wherein
the rotational drive mechanism supports the rotatable cam so as to be rotatable and axially movable,
the rotatable cam is axially moved backward under the writing pressure applied to the writing lead and is axially moved forward by release of the writing pressure,
the upper cam face and the lower cam face of the rotatable cam are formed by a plurality of circular cam faces, and
the first fixed cam and the second fixed cam are formed by a plurality of circular cam faces.

3. The mechanical pencil according to claim 2, wherein
the cam faces of the first and second fixed cams are formed on funnel-shaped inclined surfaces, and
the upper cam face and the lower cam face of the rotatable cam are formed on conical inclined surfaces.

4. The mechanical pencil according to claim 1, wherein
the first fixed cam is formed in a first cylindrical cam formation member,
the second fixed cam is formed in a second cylindrical cam formation member, and
the first cam formation member and the second cam formation member are axially joined together.

5. The mechanical pencil according to claim 1, wherein
the first fixed cam and the second fixed cam are formed within a base member arranged at a front end portion of a body cylinder constituting an outer part of the mechanical pencil, and the rotatable cam including the upper and lower cam faces is molded integrally with a slider positioned in the base member.

6. The mechanical pencil according to claim 1, wherein the first fixed cam is formed at a stopper attached to a rear end portion of the base member, the second fixed cam is formed in the base member, and the rotatable cam including the upper and lower cam faces is accommodated in the base member.

7. A mechanical pencil, comprising:

a rotational drive mechanism including a rotatable cam, and a holder member, wherein the rotatable cam is rotationally driven according to writing pressure applied to a writing lead, such that rotational motion of the rotatable cam is transferred to the writing lead, wherein the holder member supports the rotatable cam so as to be rotatable and axially movable, wherein the rotatable cam is axially moved backward under the writing pressure applied to the writing lead and is axially moved forward by release of the writing pressure, wherein the rotatable cam has upper and lower surfaces orthogonal to the axial direction formed with upper and lower cam faces, the upper and lower cam faces being circular, wherein a first fixed cam and a second fixed cam are formed at a base portion and a tip portion of an axially long elastic member molded integrally with the holder member, so as to face each other with the upper and lower cam faces of the rotatable cam therebetween, wherein the second fixed cam at the tip portion of the elastic member is formed on an inclined surface bent at an obtuse angle from the longitudinal tip portion of the elastic member toward an axis of the holder member, and wherein the lower cam face of the rotatable cam meshing with a cam face of the second fixed cam is formed on a conical inclined surface.

8. The mechanical pencil according to claim 7, wherein a cylindrical portion is formed at the base portion of the elastic member in the holder member to support the rotatable cam so as to be rotatable and axially movable, the first fixed cam with a plurality of circular cam faces is formed at the cylindrical portion, the cam faces of the first fixed cam are formed on a funnel-shaped inclined surface, and the cam face of the upper cam in the rotatable cam meshing with the cam faces of the first fixed cam is formed on a conical inclined surface.

9. The mechanical pencil according to claim 7, wherein the second fixed cam is configured such that two cam faces intersect with each other at one ridge line on an inclined surface bent at an obtuse angle from the longitudinal tip portion of the elastic member toward the axis to shape a sawtooth cam, and a line extended from the ridge line is directed toward the axis.

10. The mechanical pencil according to claim 9, wherein the second fixed cam is formed to meet the relationship $\alpha 1<\alpha 2$ where the angle formed by the inclined surface bent at an obtuse angle from the longitudinal tip portion of the elastic member toward the axis and the line directed toward the longitudinal tip portion of the elastic member is designated as $\alpha 1$, and the angle formed by the ridge line of the cam in the second fixed cam and the line directed toward the longitudinal tip portion of the elastic member is designated as $\alpha 2$.

11. The mechanical pencil according to claim 7, wherein an abutting portion is formed on the outer surface of the elastic member to be in abutment with a part of an inner periphery of the body cylinder constituting an outer part of the mechanical pencil or a part of the inner periphery of a member arranged between the body cylinder and the holder member, and the abutting portion is configured to reduce the degree of expansion of the elastic member from the axis toward the outside.

12. The mechanical pencil according to claim 11, wherein a tapered face is formed at the tip portion of the elastic member, and a part of the body cylinder or a part of the member arranged between the body cylinder and the holder member comes into axial contact with the tapered face to provide a biasing force to cause the elastic member to expand from the axis toward the outside.

13. The mechanical pencil according to claim 7, wherein the holder member includes a cushion member to push axially the rotatable cam supported by the holder member, a slip member is arranged between the cushion member and the rotatable cam to come into contact with the axial rear end surface of the rotatable cam and slip between the cushion member and the rotatable cam, and the slip member is attached to the cushion member.

14. The mechanical pencil according to claim 13, wherein the cushion member is attached to the holder member by two-color molding, and the slip member is attached to the cushion member by two-color molding.

15. A mechanical pencil, comprising:

rotational drive mechanism including a rotatable cam, a holder member, and wherein the rotatable cam is rotationally driven according to writing pressure applied to a writing lead, such that rotational motion of the rotatable cam is transferred to the writing lead, wherein the holder member supports the rotatable cam so as to be rotatable and axially movable, wherein the rotatable cam is axially moved backward under the writing pressure applied to the writing lead and is axially moved forward by release of the writing pressure, wherein the rotatable cam has upper and lower surfaces orthogonal to the axial direction formed with upper and lower cam faces, the upper and lower cam faces being circular, wherein a first fixed cam and a second fixed cam are formed at a base portion and a tip portion of an axially long elastic member molded integrally with the holder member, so as to face each other with the upper and lower cam faces of the rotatable cam therebetween, wherein a cylindrical portion is formed at the base portion of the elastic member in the holder member to support the rotatable cam so as to be rotatable and axially movable, wherein the first fixed cam with a plurality of circular cam faces is formed at the cylindrical portion, wherein the cam faces of the first fixed cam are formed on a funnel-shaped inclined surface, and wherein the upper cam face of the rotatable cam meshing with the cam faces of the first fixed cam is formed on a conical inclined surface.

* * * * *